US011214961B2

(12) United States Patent
Frederick

(10) Patent No.: US 11,214,961 B2
(45) Date of Patent: Jan. 4, 2022

(54) WINDOW AND CURTAIN WALL MULLIONS, TRANSOMS AND SYSTEMS

(71) Applicant: FreMarq Innovations, Inc., Merrill, WI (US)

(72) Inventor: Todd Frederick, Merrill, WI (US)

(73) Assignee: FreMarq Innovations, Inc., Merrill, WI (US)

( * ) Notice: Subject to any disclaimer, the term of this patent is extended or adjusted under 35 U.S.C. 154(b) by 128 days.

(21) Appl. No.: 16/182,871

(22) Filed: Nov. 7, 2018

(65) Prior Publication Data

US 2019/0194939 A1 Jun. 27, 2019

Related U.S. Application Data

(63) Continuation-in-part of application No. 15/487,624, filed on Apr. 14, 2017, now Pat. No. 10,450,743, which is a continuation-in-part of application No. 14/932,631, filed on Nov. 4, 2015, now Pat. No. 9,663,946, which is a continuation-in-part of application No. 14/314,636, filed on Jun. 25, 2014, now Pat. No. 9,212,482.

(60) Provisional application No. 61/943,786, filed on Feb. 24, 2014.

(51) Int. Cl.
*E04B 2/96* (2006.01)
*E04B 2/90* (2006.01)

(52) U.S. Cl.
CPC ..... *E04B 2/965* (2013.01); *E04B 2/90* (2013.01); *E04B 2/967* (2013.01)

(58) Field of Classification Search
CPC . E04B 2/965; E04B 2/90; E04B 2/967; E04B 2/885
USPC ..... 52/235, 717.02, 204.51, 208, 204.591, 52/204.593
See application file for complete search history.

(56) References Cited

U.S. PATENT DOCUMENTS 4,841,700 A * 6/1989 Matthews ..... E06B 3/26307 49/DIG. 1
4,891,912 A * 1/1990 Bockwinkel ..... A47F 3/043 49/484.1
5,355,645 A * 10/1994 Farag ..... E04B 2/96 52/235

(Continued)

*Primary Examiner* — Brian E Glessner
*Assistant Examiner* — Adam G Barlow
(74) *Attorney, Agent, or Firm* — Anthony J. Bourget

(57) ABSTRACT

Methods, structures and systems for environmental isolation of metal window, transom and mullion surfaces, including in one aspect a metal frame structure configured to receive an operable window, the frame structure having a first thermally insulated polymer component connected to a side of the frame structure at a side wall and spanning a total width of the side wall, and an operable window having a second thermally insulated polymer component connected to a sash assembly, the window configured to close to a position defining a first gap between the second thermally insulated polymer component and the first thermally insulated polymer component and a second gap between the sash assembly and the frame structure. In one aspect at least one seal is positioned in the first gap and abutting both the second component and the first component and at least one seal positioned in the second gap and abutting both the sash assembly and the frame structure to provide improved insulation effectiveness.

20 Claims, 28 Drawing Sheets

(56) References Cited

U.S. PATENT DOCUMENTS

| | | | | |
|---|---|---|---|---|
| 6,857,233 | B2 * | 2/2005 | Farag | E04B 2/96 52/235 |
| 7,096,640 | B1 * | 8/2006 | Chevian | E06B 3/2675 52/204.591 |
| 8,484,902 | B1 * | 7/2013 | Brown | E06B 3/26341 49/504 |
| 2002/0148178 | A1 * | 10/2002 | Farag | E06B 5/165 52/204.1 |
| 2008/0295425 | A1 * | 12/2008 | Farag | B32B 17/10055 52/235 |
| 2014/0345215 | A1 * | 11/2014 | Magoon | E06B 3/5427 52/235 |

* cited by examiner

WINDOW AND CURTAIN WALL MULLIONS, TRANSOMS AND SYSTEMS

CROSS-REFERENCE TO RELATED APPLICATIONS

The present application is a continuation-in-part of, and claims priority to, co-pending U.S. patent application Ser. No. 15/487,624, filed Apr. 14, 2017, which is a continuation-in-part of, and claims priority to, U.S. patent application Ser. No. 14/932,631, filed Nov. 4, 2015, approved as U.S. Pat. No. 9,663,946 issued on May 30, 2017, which is a continuation-in-part of, and claims the benefit and priority of U.S. patent application Ser. No. 14/314,636, filed Jun. 25, 2014, approved as U.S. Pat. No. 9,212,482 issued on Dec. 15, 2015, which claims the benefit and priority of Provisional Patent Application Ser. No. 61/943,786 filed Feb. 24, 2014, which are hereby incorporated by reference as if fully reproduced herein.

BACKGROUND OF THE INVENTION

There are curtain wall systems or frameworks in which glazing or other panels are fitted. Curtain walls typically comprise a grid-like framework usually made of aluminum profiled members arranged with transoms (i.e., structures that typically run horizontally) and mullions (i.e., structures that typically run vertically). Glazing or window panels and non-transparent panels may be secured against the transoms and mullions. The framing is attached to a building structure. There are also window wall systems in which glazing or other panels are fitted within or between concrete floor slabs, for instance, or within or between other framing.

SUMMARY OF THE INVENTION

The invention pertains to a window or curtain wall system and separate elements such as mullions or transoms that include a thermally insulating component. In some embodiments, the insulating component is a fiberglass component such as a fiberglass reinforced polymer that is bonded to a metal structure. The insulating component is connected to the metal structure without bonding or via an interlock in different aspects. The metal structure may be made of steel or aluminum or other metal for instance. The bonding is accomplished using adhesives and/or other bonding techniques and produces a mullion or transom having sufficient strength to support the panels or glazing of the curtain wall or window wall. The thermally insulating fiberglass component enhances the insulating properties of the mullions, transoms and curtain and window wall system. The insulating component in some instanced may also be fastened to the metal structure using fasteners (and/or may include both fasteners and adhesives or other bonding mechanism).

In accordance with an aspect of the invention, a steel mullion or transom includes a stem projecting from the mullion or transom where the stem is configured to project into a space between a first panel and a second panel of a curtain wall. Since the stem is made of thermally insulating material the structure provides enhanced overall insulating properties of a resultant curtain wall system.

In a further aspect of the invention, a mullion or transom for use on a curtain wall system having at least one panel comprises a metal structural segment and a component made of thermally insulating material and bonded to the metal segment, the component including a seal receiver configured to receive a seal to be positioned between the metal segment and the panel In a further aspect of the invention a curtain wall system includes a cell having a first mullion, a second mullion, a first transom and a second transom, the first transom including a metal structure having a fiberglass component bonded to the metal structure, a panel secured to the cell, the fiberglass component including a stem configured to support a weight of the panel.

In a further aspect the invention includes a method of making a component by pultruding a fiberglass to have a profile configured to cover an entirety of an outside of a mullion or transom of a curtain wall and to have a pair of receivers for receiving seals to abut against panels of the curtain wall. Further profiles are contemplated under the methods of making components by pultrusion.

In a further aspect of the invention a metal window wall or curtain wall mullion or transom has an outer side and a component connected to the outer side by a first fastener passing through the outer side and into the component. The fastener is inserted from the inside-out, i.e., from the inside of the metal structure, through the outer side, and into the component. In one aspect an optional second fastener passes through a pressure plate and into the component at or from an outer side of the component.

In a further aspect of the invention, a mullion or transom for use on a window wall includes a metal mullion or transom structure having an outer side and a component connected to the metal structure at the outer side by a first fastener passing through the metal structure and into the component, the component covering substantially an entirety of the outer side, the first fastener oriented generally parallel to the outer side. In further aspects the component is connected to the metal structure at the outer side by an interlocking connection between the component and the metal structure, the component covering an entirety of the outer side and having an integral stem projecting into a space between a first panel and a second panel of the window wall or curtain wall system. The interlocking connection may include multiple interlocks. In aspects the interlocking connection is the sole connection between the component and the metal structure. In further aspects the interlocking connection is supplemented with a bonding connection and/or a fastener. In some aspects the component is connected to a metal structure used with operable windows or windows that open (such as windows that project outward with a top hinge or use some other operable arrangement or orientation).

In a further aspect of the invention, a thermally insulating component or components is bonded to a metal segment such that an entirety or substantially an entirety of an outer face of the metal segment is covered by the component and where the component projects into a space defined between panels of the system. In one aspect the component covers a stem of an existing structure which stem projects at least partially into the space. The aspect may be used as a retrofit of existing systems. The component in one aspect is a two piece component, with each piece bonded, by adhesive such as an adhesive tape or other adhesive, to the structure to cover the outer face. A retrofit method utilizing the foregoing is also presented as an aspect of the invention.

The above partial summary of the present invention is not intended to describe each illustrated embodiment, aspect, or every implementation of the present invention. The figures and detailed description and claims that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which.

Figure 1:
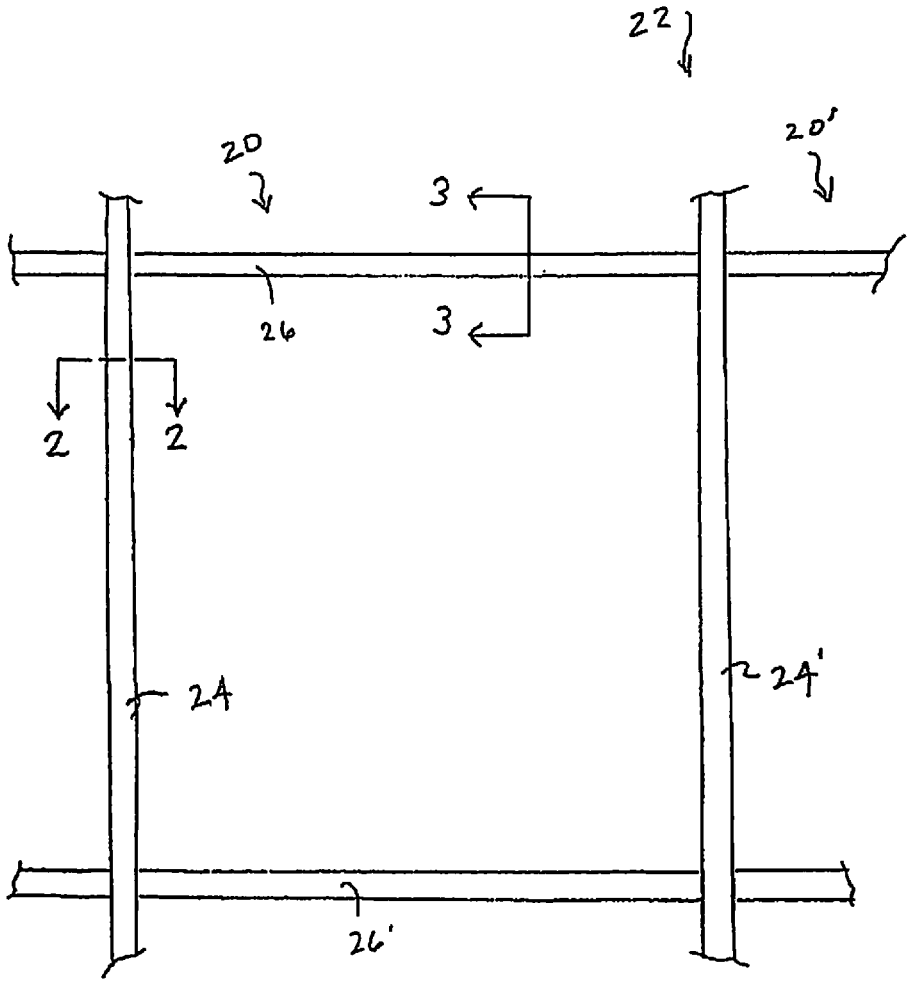
FIG. 1 is a front view of a cell of a curtain wall system according to some embodiments of the present invention.

While the invention is amenable to various modifications and alternative forms, specifics thereof have been shown by way of example in the drawings and will be described in detail. It should be understood, however, that the intention is not necessarily to limit the invention to the particular embodiments, aspects and features described. On the contrary, the intention is to cover all modifications, equivalents, and alternatives falling within the spirit and scope of the invention and as defined by the appended claims.

DETAILED DESCRIPTION OF THE INVENTION

Figure 2:
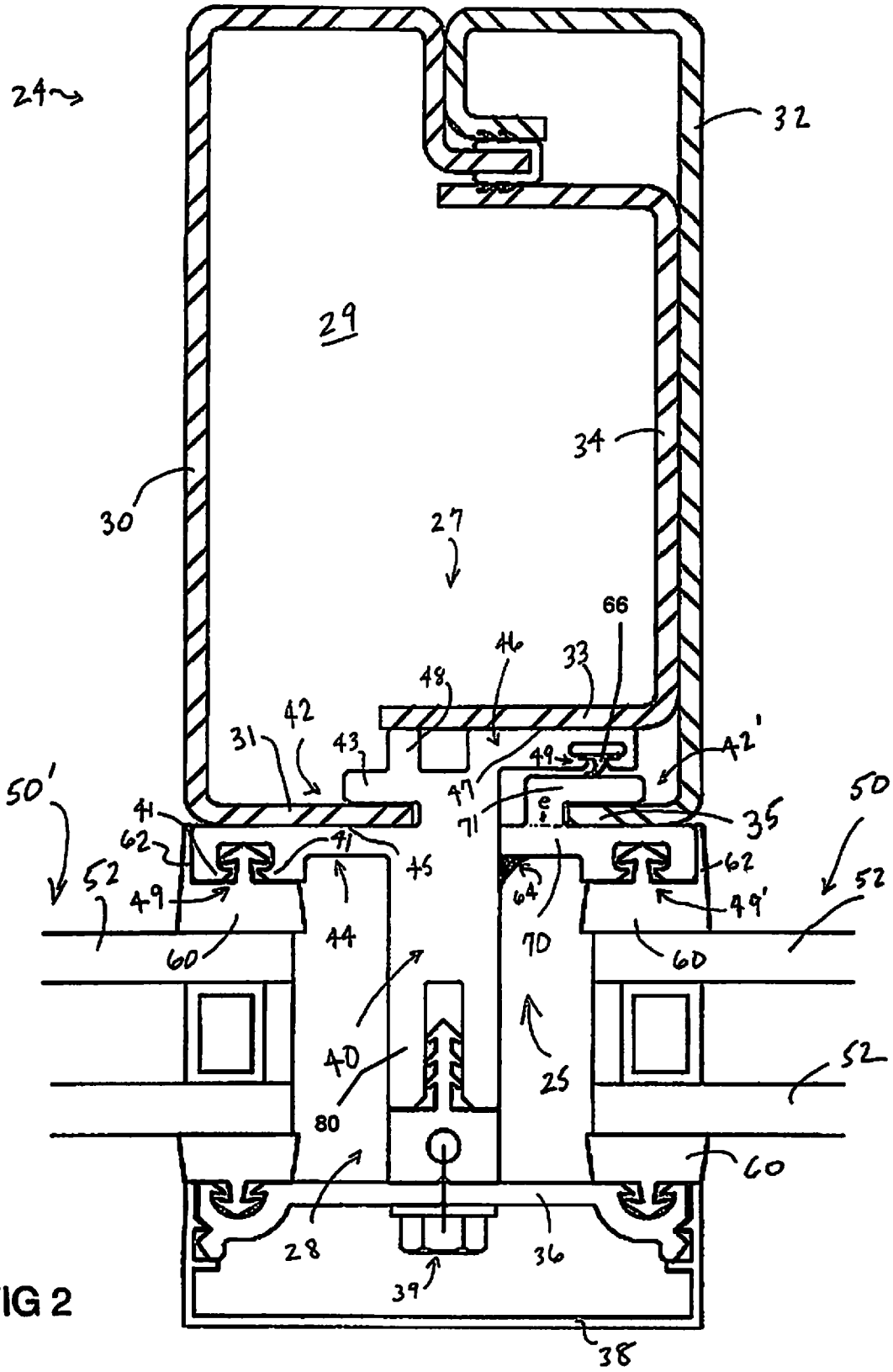
FIG. 2 is a sectional view of a mullion along line 2-2 of FIG. 1, according to some embodiments.

FIG. 1 is a front view of a cell 20 of a curtain wall system 22 according to some embodiments. System 22 is shown in partial (and panels are not shown). It may be appreciated that multiple cells 20 may comprise system 22. FIG. 2 is a sectional view of a mullion 24 of cell 20. FIG. 3 is a sectional view of a transom 26 of cell 20. A similar transom 26' is positioned generally parallel with transom 26. A similar mullion 24' is positioned generally parallel with mullion 24. Together mullions 24, 24' and transoms 26, 26' comprise a single cell 20 of curtain wall system 22. It may be appreciated that mullions 24 and transoms 26 also comprise additional cells 20' or components of cells 20' of system 22. It may be appreciated that panels such as windows, glass, or plates or other objects may be inserted within a cell 20 to cover or span the space, light or opening created by mullions 24 and transoms 26.

As shown in FIG. 2, mullion 24 includes a first mullion segment 30. In some embodiments mullion 24 includes a second mullion segment 32 and a third mullion segment 34. Mullion segments 30, 32 and 34 form a mullion 24 and define a mullion cavity 29. In some embodiments mullion 24 is made of steel. Particularly, segments 30, 32 and 34 may be made of steel. In one example, segments 30, 32 and 34 may be formed by bending 12 gage steel sheets. In one aspect mullion 24 includes a polymer component 40 which is bonded to mullion 24. Polymer component 40 is formed of a thermally insulating material. In one aspect polymer component 40 is made of fiberglass reinforced polymer (FRP) or glass-fiber reinforced polymer (GFRP) which in one example is a fiber reinforced polymer including plastic. A variety of glass, fiberglass and/or plastics may be used. In one aspect polymer component 40 is made of material including fiberglass and polyester, or fiberglass and vinyl ester, or fiberglass and polymers, and may include non-fire retardant materials or fire retardant materials. Polymer component 40 may be made using a pultrusion process and may include reinforcing structures or mats to provide structural support. Rovings may be located in the component 40 which may also include an external coating or coatings. Polymer component 40 thus has favorable insulating features. In one aspect involving steel structural segments 30, 32 and 34, polymer component 40 fills a gap that would otherwise lead from outer side 25 to cavity 29.

In one aspect polymer component 40 is bonded to mullion 24 with an adhesive. A variety of bonding ingredients and techniques may be used to secure polymer component 40 to mullion 24. As shown in one aspect, polymer component 40 includes an interlock 42 which is configured to receive tail 31 of first mullion segment 30. Tail 31 may be both friction fit within interlock 42 and also bonded within interlock 42 with an adhesive and/or bonding treatments. In one aspect interlock 42 is a gap defined by polymer component 40. Polymer component 40 may include a lip 43 which in part defines interlock 42 as shown. Polymer component 40 also includes a first arm 44 having a tail-contact surface 45 which is bonded to the outside surface of tail 31. In one aspect, tail contact surface 45 covers the entire area of the outside surface of tail 31. In this manner tail 31 is not exposed to the outside element which would otherwise tend to corrode or deteriorate tail 31. Polymer component 40 also includes a second arm 46 having a tail contact surface 47 which in one aspect may be bonded to the outside surface of tail 33 of third mullion segment 34. In one aspect tail contact surface 47 may cover the entirety of the outside surface of tail 33. It may be appreciated that contact surface 47 may also cover less than the entirety of the outside surface of tail 33. Polymer component 40 may also include a further lip 48 configured to adhere to tail 33. In further aspects arm 46 may loosely fit against tail 33 (i.e., not be bonded) so that arm 46 may slide with respect to tail 33. Likewise, lip 48 may also be a loose fit against tail 33. It may be appreciated that alternative configurations of polymer component 40 may be used to assist in adhering polymer component 40 to mullion 24 (whether adhering to segment 30, 32 or 34). Polymer component 40 is configured to adhere to mullion 24 while also having a stem portion 80 extending between or into a gap or pocket defined in part by panels 50, 50'. A fastener 39 may insert through a pressure plate 36 and into the stem to secure panels 50, 50' in position. Seals 60, 60 may be positioned between pressure plate 36 and panel frame 52. A cover plate 38 may be positioned to cover pressure plate 36. It may be appreciated that panel 50 may be positioned within cell 20 while panel 50' may be positioned within an adjacent cell 20'.

In a further aspect polymer component 40 includes a seal receiver 49 configured to receive a seal 60. In one aspect seal receiver is defined by seal fingers 41. Seal 60 is configured to insert into seal receiver 49 and between first arm 44 and panel frame 52. Seal 60 may fiction fit to panel frame 52 and may also be bonded to panel frame 52. Seal 60 may be of a conventional variety used in curtain wall systems. Seal 60 may also include a wrap segment 62 to partially cover an edge of first arm 44. In a further aspect polymer component 40 includes a further seal receiver 49 positioned at or defined by second arm 46. In one aspect seal receiver 49 may be configured to receive a seal 66 configured to interact with a shoulder 70 described below. In one aspect seal 66 is positioned between second mullion segment 32 and third mullion segment 34.

As shown in FIG. 2 mullion 24 includes a shoulder 70 connected to second mullion segment 32. In one aspect shoulder 70 includes an interlock 42'. Interlock 42' is configured to receive tail 35 of segment 32. Tail 35 may friction fit within interlock 42' and/or be bonded to shoulder 70 within interlock 42'. Shoulder 70 is made from the same or similar material as is polymer component 40 described above. In one aspect shoulder 70 abuts polymer component 40. A sealant 64 may be applied where shoulder 70 meets polymer component 40. In a further aspect shoulder 70 includes a seal receiver 49'. Receiver 49' is configured to receive a seal 60. In one aspect seal receiver 49' is defined by seal fingers 41. Seal 60 is configured to insert into seal receiver 49' and between shoulder 70 and panel frame 52. Seal 60 may friction fit to panel frame 52. Seal 60 may be of a conventional variety used in curtain wall systems. Panel frame 52 may also be secured to seal 60 with an adhesive. Seal 60 may also include a wrap segment 62 to partially cover an edge of shoulder 70. In a further aspect shoulder 70 may be configured without elbow 71 (i.e., elbow extends from shoulder 70 at line "e" as shown in FIG. 2). Tail 35 may extend further toward tail 31 to lessen a gap there between. Shoulder 70 may friction fit or interlock and/or bond to tail 35.

It may be appreciated that polymer component 40 and shoulder 70 combine to cover the entirety of the outer side 25 of mullion 24. Particularly, polymer component 40 and shoulder 70 are configured such that no portion of mullion 24 is exposed to outer side 25, nor is any segment of mullion 24 in communication with the panels 50, 50' or the pocket 28 between panels 50, 50'. Maintaining the segments of mullion 24 in isolation from the outside atmosphere improves the insulating characteristics of system 22.

As shown, mullion 24 is a composite structure made of steel segments 30, 32, 34 to which the fiberglass items, such as polymer component 40 and shoulder 70 are bonded or laminated. Polymer component 40 and shoulder 70 are configured to remain connected to mullion 24. In one aspect polymer component 40 and shoulder 70 are continuous in that they span the length of mullion 24.

Figure 3A:
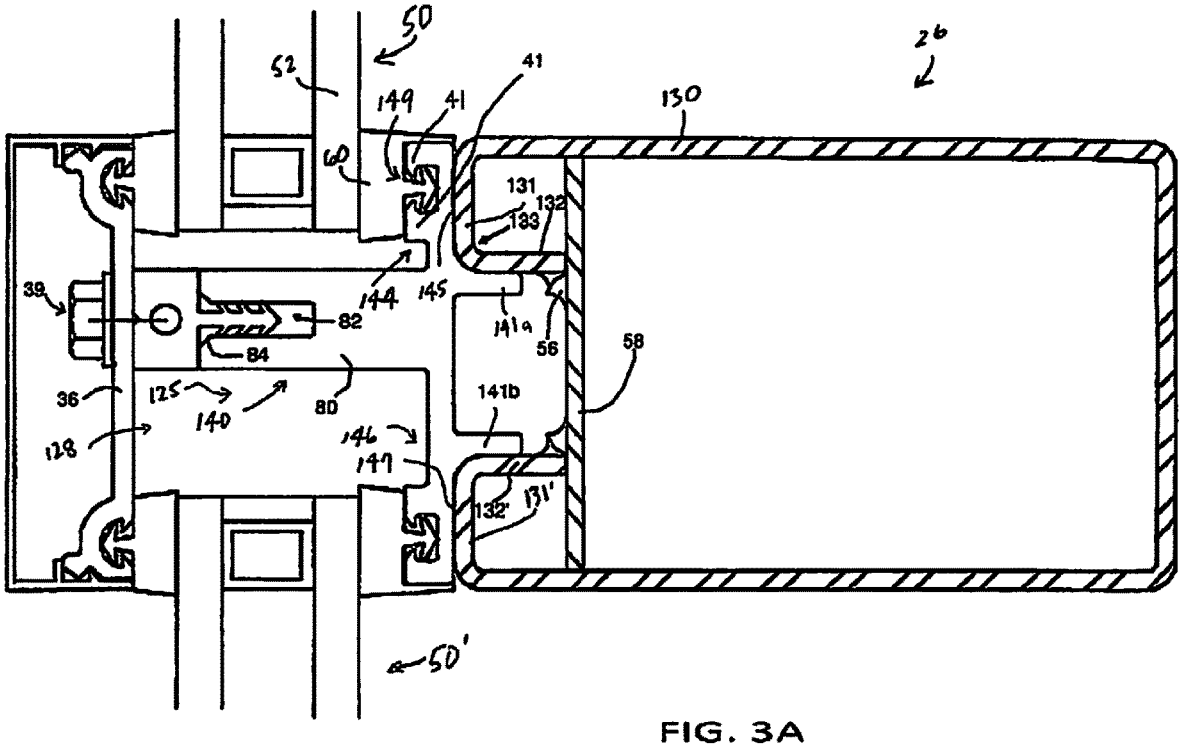
FIG. 3A is a sectional view of a transom along line 3-3 of FIG. 1, according to some embodiments.

As shown in FIG. 3A, transom 26 (i.e., a horizontally oriented element of cell 20) includes polymer component 140 which is made of material that is the same or similar to the material used to make polymer component 40 referenced above. Polymer component 140 includes a first arm 144 having a transom contact surface 145 and a second arm 146 having a transom contact surface 147. In one example component 140 is bonded to transom 26 at least at contact surfaces 145, 147. Particularly, first arm 144 and second arm 146 may be bonded with an adhesive and other bonding techniques to transom wall 130. Wall 130 is formed of metal and in one aspect is formed of steel and in one aspect is bent into configuration.

As shown in FIG. 3A, wall 130 includes receiving arm 131, 131'. In one aspect arm 131 is integrally connected to wall 130 and is configured to receive contact surface 145. Receiving arm 131 may be bent into position as shown for instance in FIG. 3 and then welded to transom plate 58 at weld 56. In one aspect receiving arm 131 leads to receiving hand 132 and hand 132 is in turn welded to transom plate 58 with weld 56. It may be appreciated that hand 132' may be oriented parallel or at least substantially parallel with hand 132. As such, hand 132 and hand 132' are opposing walls. Polymer component 140 further includes fingers 141*a*, 141*b* configured to bond with wall 130. In one aspect finger 141*a* is bonded to hand 132 and finger 141*b* is bonded to hand 132'. An adhesive may be applied between polymer component 140 and wall 130 to securely bond component 140 along an entirety of the exterior surface of arm 131 and continuing about the curve 133 and along hand 132. Likewise an adhesive may be applied to securely bond component 140 along an entirety of the exterior surface of arm 131' and continuing about the curve and along hand 132'. It may be appreciated that the combination of adhesive and the structural matching arrangement of fingers 141 combine to provide a secure bond sufficient to allow component 140 to withstand the forces associated with bearing the weight of panels 50, 50' and other forces associated with or applied to the panels.

Fingers 141*a*, 141*b* also allow for efficient alignment of component 140 onto wall 130. Fingers 141 are positioned on component 140 to match the gap between hands 132, 132' and to also receive an adhesive between component 140 and wall 130. Wall 130 is bent with corners 133 to match the contour of finger 141*a* (and/or vice versa) and the same is presented with finger 141*b* and at a distance to match the gap between hands 132, 132', to provide a secure bond. A variety of steps for preparing the surfaces and/or curing or treating the adhesives, as needed, may be used to achieve a secure bond of component 140 to wall 130. It may be appreciated that fingers 141 may be positioned in different locations, and in some applications may be reconfigured into different shapes/dimension and/or removed altogether.

It may be appreciated that polymer component 140 covers the entirety of outer side 125 of transom 26. Such configuration assures that no portion of transom 26 is in communication with the exterior atmosphere or panels 50, 50' or the pocket 28 between panels 50, 50'. Maintaining such isolation improves the insulating characteristics of system 22.

In a further aspect polymer component 140 includes a seal receiver 149. Receiver 149 is configured to receive a gasket or seal 60. In one aspect seal receiver is defined by seal fingers 41. Seal 60 is configured to insert into seal receiver 149 and between component 40, 140, and panel frame 52, i.e., between first arm 144 and panel frame 52. Seal 60 may be bonded to panel frame 52. Seal 60 may be of a conventional variety used in curtain wall systems.

In one aspect a pressure plate 36 is fastened with a screw 39 to stem 80 of component 140 and applies pressure to seals 60 which in turn apply pressure to panels 50, 50' and against component 140. It may be appreciated that a setting block may be positioned between stem 80 and panel 50. It may be appreciated that component 140 together with pressure plate 36 secure panels 50, 50' to transom 26.

Figure 3B:
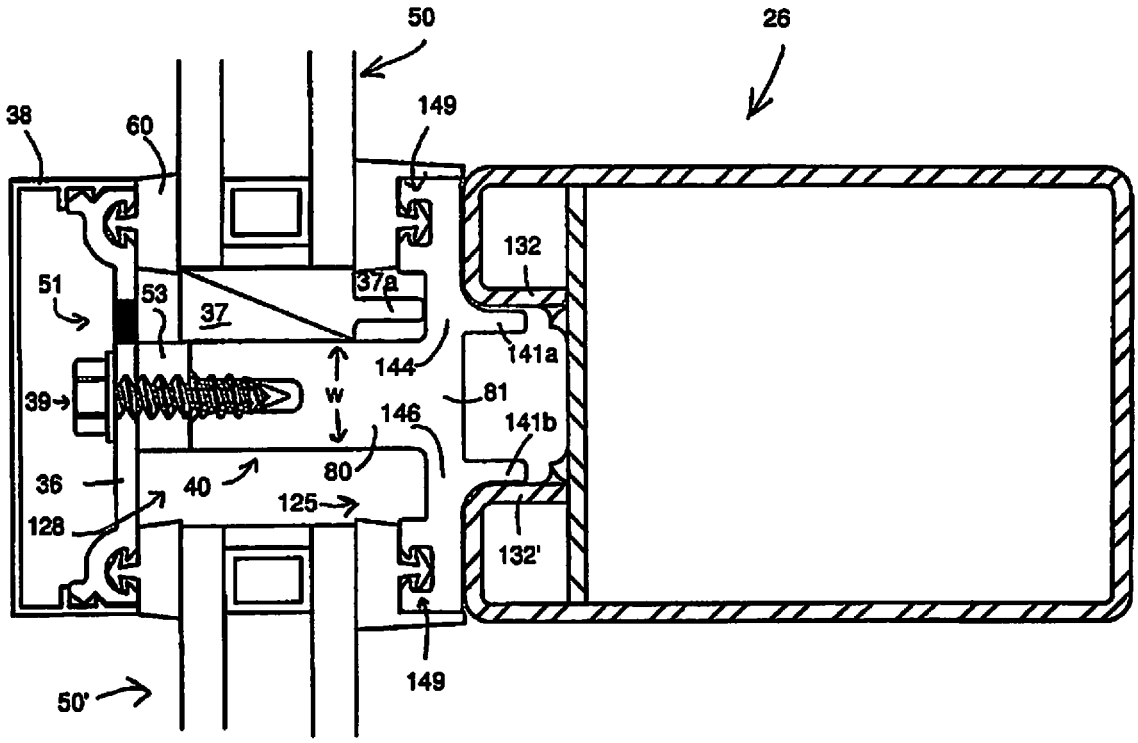
FIG. 3B is a sectional view of a transom along line 3-3 of an alternative aspect of FIG. 1, according to some embodiments.

In a further aspect the stem 80 includes a groove 82 configured to receive a fastener 39 (see also FIG. 3B). Groove 82 may include a taper 84 to assist in receiving fastener 39. Groove 82 may be a continuous groove which spans the length of component 40, 140. It may be appreciated that groove 82 operates as a pilot hole to receive and contain fastener 39. In one aspect groove 82 is configured to securely receive a fastener such as a screw, including a #14 stainless steel HWH SMS screw. A plurality of screws 39 may be inserted along transom to secure a plurality of panels 50, 50' into position. In one instance screws 39 may be positioned at 9 inches on center. Other arrangements may be used as desired.

FIG. 3B shows a further aspect of transom 26 having a symmetrically disposed polymer component 140. Also shown is a setting block 37 positioned between component 140, particularly, between the stem 80 of component 40, and a panel 50. In one example setting block 37 is a silicone block of about 4 inches to 6 inches in length. Block 37 may also be a continuous length to match the length of transom 26 or in other examples may be a shorter length. Block 37 may include a block tip 37*a* which is a projection from block 37 configured to abut component 40 for appropriate spacing of block 37 beneath panel 50 within pocket 128. In one example a number of setting blocks 37 may be used and staggered at various locations along the system 22. Blocks 37 may be positioned at quarter points along panel 50, for example. Block 37 or blocks 37 allow for the weight of a panel 50 to be transferred to the stem 80 or polymer component 40. Use of blocks 37 may also be employed with reference to FIG. 5 and FIG. 7. In this manner the weight of panels 50 is supported by polymer component 40. Pressure plate 36, which is secured to polymer component 40 by a fastener 39, for instance, applies pressure to seals 60, 60, which in turn apply pressure to panels 50,50'. In one aspect seal 60 may include, for instance, a 60 durometer silicone gasket. The interior side seal 60 may include a lineal or molded corner configuration for instance. Pressure plate 36 may also include a weep hole 51 which is an aperture defined by plate 36. Weep hole 51 allows for moisture to escape from pocket 128. A gasket, such as gasket 53 may be positioned between pressure plate 36 and stem 80. Gasket 53 may include a silicone material, such as a 70 durometer silicone gasket separator. It may be appreciated that polymer component 40 extends into pocket 128 between panels 50, 50'. Pressure plate 36 may extend a length of transom 26. Pressure plate 36 may include several weep holes 51 spaced at various positions along the length of plate 36. In one example weep hole 51 may be positioned on pressure plate 36 at a position above polymer component 40 as shown. This allows water or moisture to escape from below panel 50.

Figure 3C:
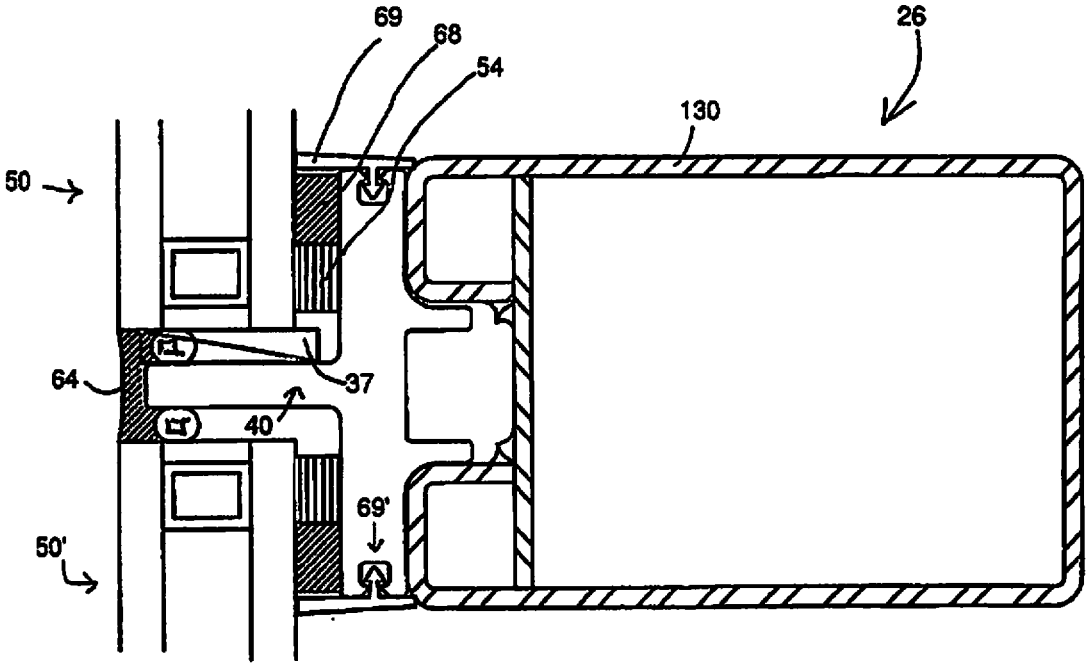
FIG. 3C is a sectional view of a transom along line 3-3 of an alternative aspect of FIG. 1, according to some embodiments.

FIG. 3C shows a further aspect of transom 26 having a symmetrically disposed polymer component 140. In this aspect the transom 26 includes a glazing tape 54 between panel 50 and component 40. In one aspect glazing tape 54 is a two sided glazing tape. Use of glazing tape 54 secures panel to polymer component 40 which is in turn secured to transom wall 130. In addition, a silicone layer 68 such as structural silicone is also positioned between panel 50 and component 40. Together the glazing tape 54 and structural silicone 68 secure panel to transom 26 while also maintaining a seal relationship. A silicone gasket 69 is positioned at an edge of component 40 and structural silicone 68 for additional insulation and/or for cosmetic purposes to conceal the structure. Gasket 69 inserts into a gasket receiver 69' of component 40. A similar arrangement may also be used to secure panel 50' to transom 26. It may be appreciated that use of glazing tape 54 and structural silicone 68, for instance, allows for securing panel 50 to transom 26 without the use of a fastener such as shown the FIG. 3A or FIG. 3B. A sealant 64 may be applied between panels 50, 50', for instance, and/or applied to stem 80 of component 40. A setting block 37 may also be used to receive panel 50.

Figure 3D:
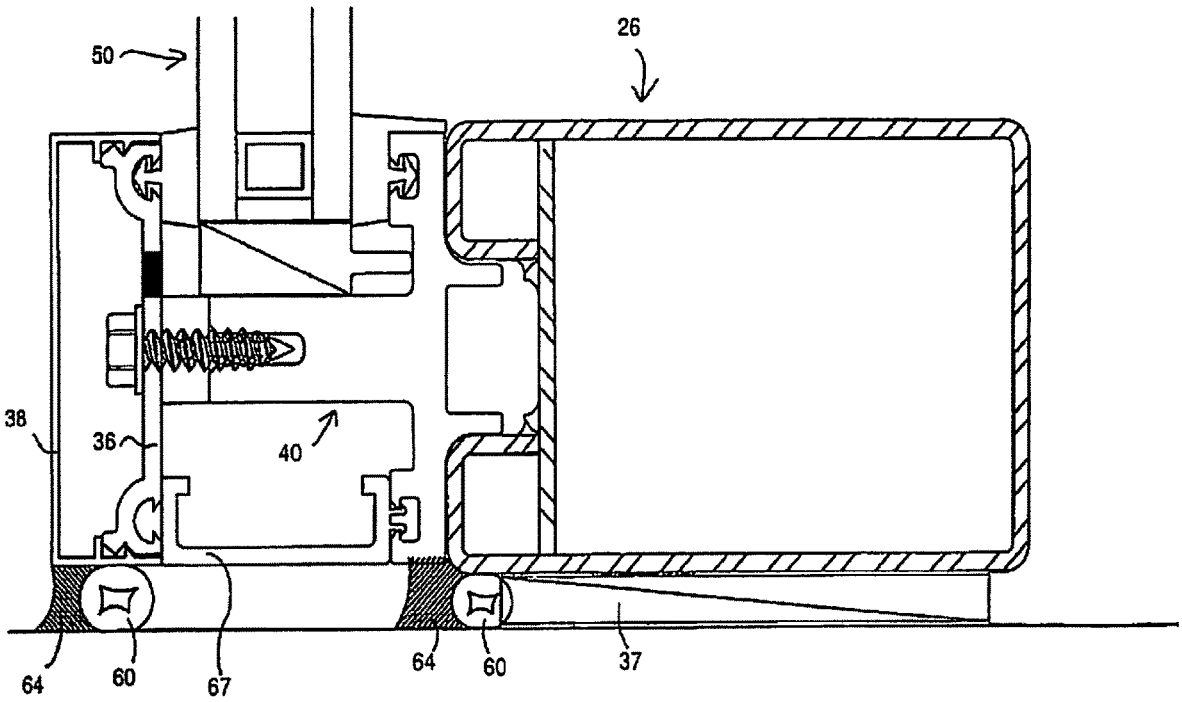
FIG. 3D is a sectional view of a transom positioned along a bottom wall of an alternative aspect of FIG. 1, according to some embodiments.

FIG. 3D shows a further aspect of transom 26 having a symmetrically disposed polymer component 40 and where the transom 26 is positioned adjacent a horizontal (such as at a bottom area of a curtain wall system). A single (upper) panel 50 is used in this aspect. A PVC spacer 67 is positioned between pressure plate 36 and component 40. A sealant 64 and seal 60 may be positioned between the horizontal and cover plate 38 and at the joint of component 40 and transom wall 130. A setting block 37 may be used to set transom 26.

Figure 4:
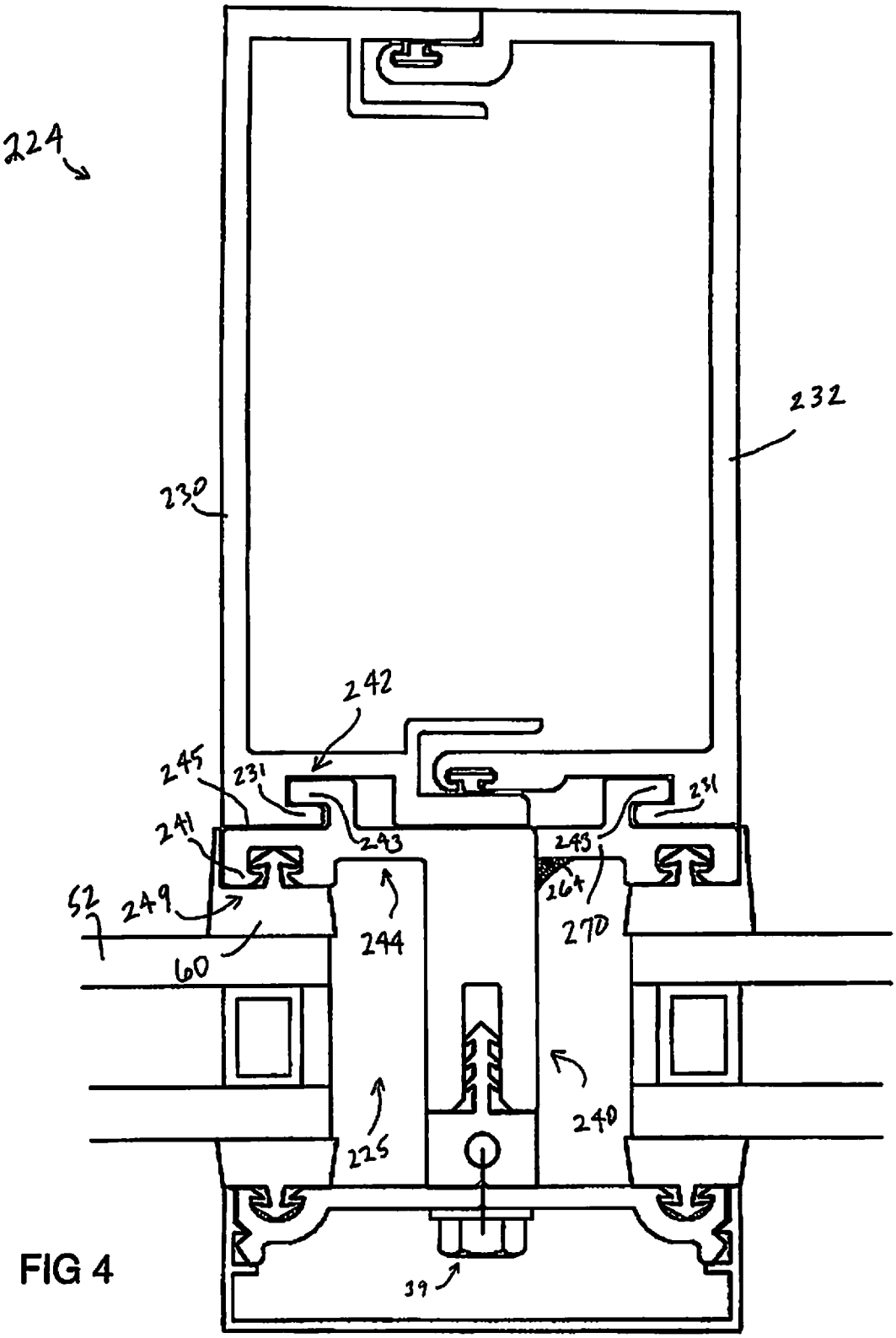
FIG. 4 is a sectional view of a mullion along line 2-2 of FIG. 1, according to some further embodiments involving use of aluminum.

As shown in FIG. 4, a further aspect of the invention is shown where mullion 224 is made of aluminum. Mullion 224 is made of a first mullion segment 230 and a second mullion segment 232. A polymer component 240 is bonded to mullion 224. In one aspect polymer component 240 is bonded, by an adhesive and other bonding techniques, to segment 230. Polymer component 240 may include an interlock 242 to receive a mullion finger of segment 230. Interlock 242 in one aspect is configured as part of first arm 244. First arm 244 may include a lip 243 which inserts into a gap defined by segment 230. Adhesive is applied to the surfaces to bond first arm 244 to segment 230. Bonding treatments and procedures are used to assure a rigid connection. In one aspect contact surface 245 is bonded to segment 230. Polymer component 240 further includes seal receiver 249. Receiver 249 is configured to receive a seal 60. In one aspect seal receiver is defined by seal fingers 241. Seal 60 is configured to insert into seal receiver 249 and between first arm 244 and panel frame 52. Seal 60 may be bonded to panel frame 52. Seal 60 may be of a conventional variety used in curtain wall systems.

As shown in FIG. 4, transom 224 further includes shoulder 270 laminated or bonded to mullion 224. Particularly shoulder 270 is rigidly connected to segment 232. Shoulder 270 includes interlock 242 which may be the same or similar to interlock 242 defined by polymer component 240. Segment 232 may also include tail 231 which may be friction fit and/or bonded within gap formed by lip 243. Shoulder 270 abuts polymer component 240 and may include seal 264. Shoulder 270 may further include seal receiver 249 to receive seal 60. Shoulder 270 and polymer component 240 are bonded to mullion 224 at outer side 225 and prevent mullion 224 from communication with panels 50, 50' or pocket 228.

Figure 5:
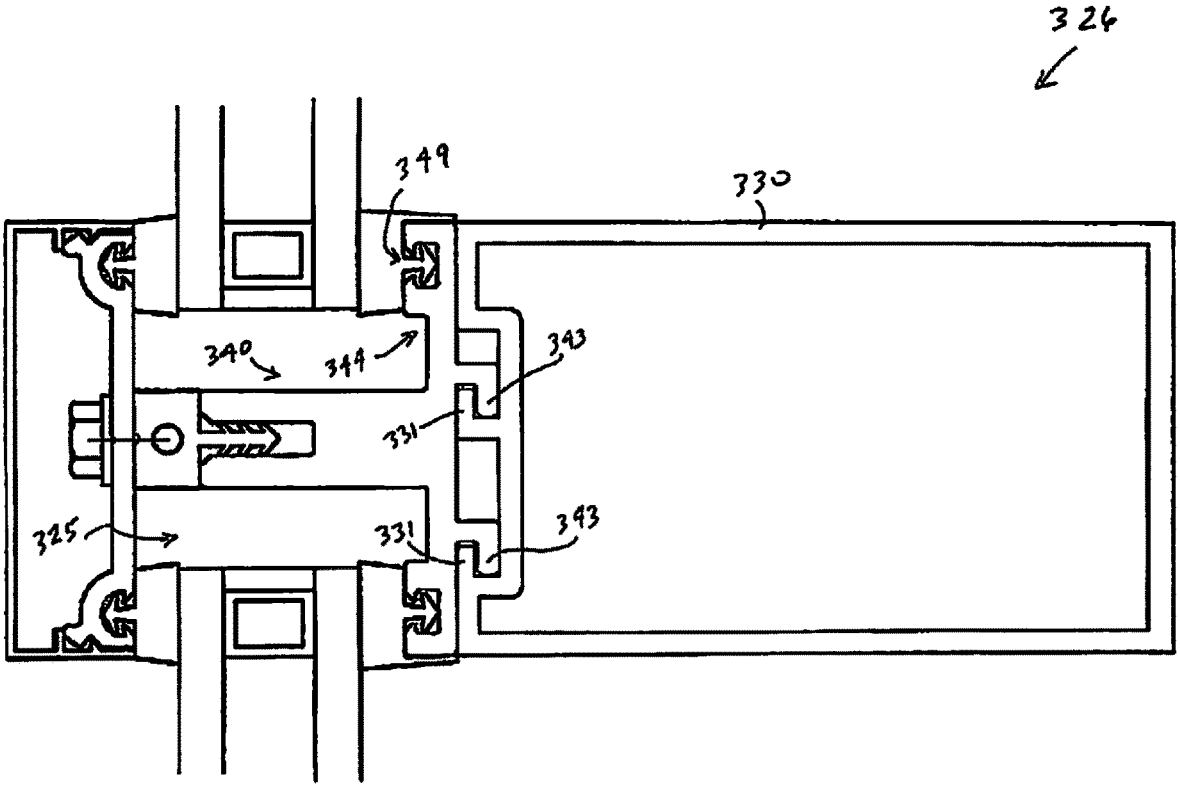
FIG. 5 is a sectional view of a transom along line 3-3 of FIG. 1, according to some further embodiments involving use of aluminum.

With reference to FIG. 5, a further aspect of transom 326 is shown which includes transom wall 330. Polymer component 340 is bonded to transom 326. Polymer component 340 is made of the same or similar material as is the polymer component 40 noted above. Polymer component 340 is configured to friction fit and/or bond with or to outer side 335 of transom 326. In one aspect polymer component 340 includes a lip 343 which inserts into a gap formed in part by tail 331 of transom wall 330. Transom 326 may be made of aluminum and may be extruded, for instance. Lip 343 and tail 331 create an interlock 342. Polymer component 340 further includes a first arm 344 which includes a seal receiver 349. Receiver 349 is configured to receive a seal 60. In one aspect seal receiver is defined by seal fingers 341. Seal 60 is configured to insert into seal receiver 349 and between first arm 344 and panel frame 52. Seal 60 may be bonded to panel frame 52. Seal 60 may be of a conventional variety used in curtain wall systems. Polymer component 340 in this aspect completely covers outer side 325 of transom 326.

Figure 6:
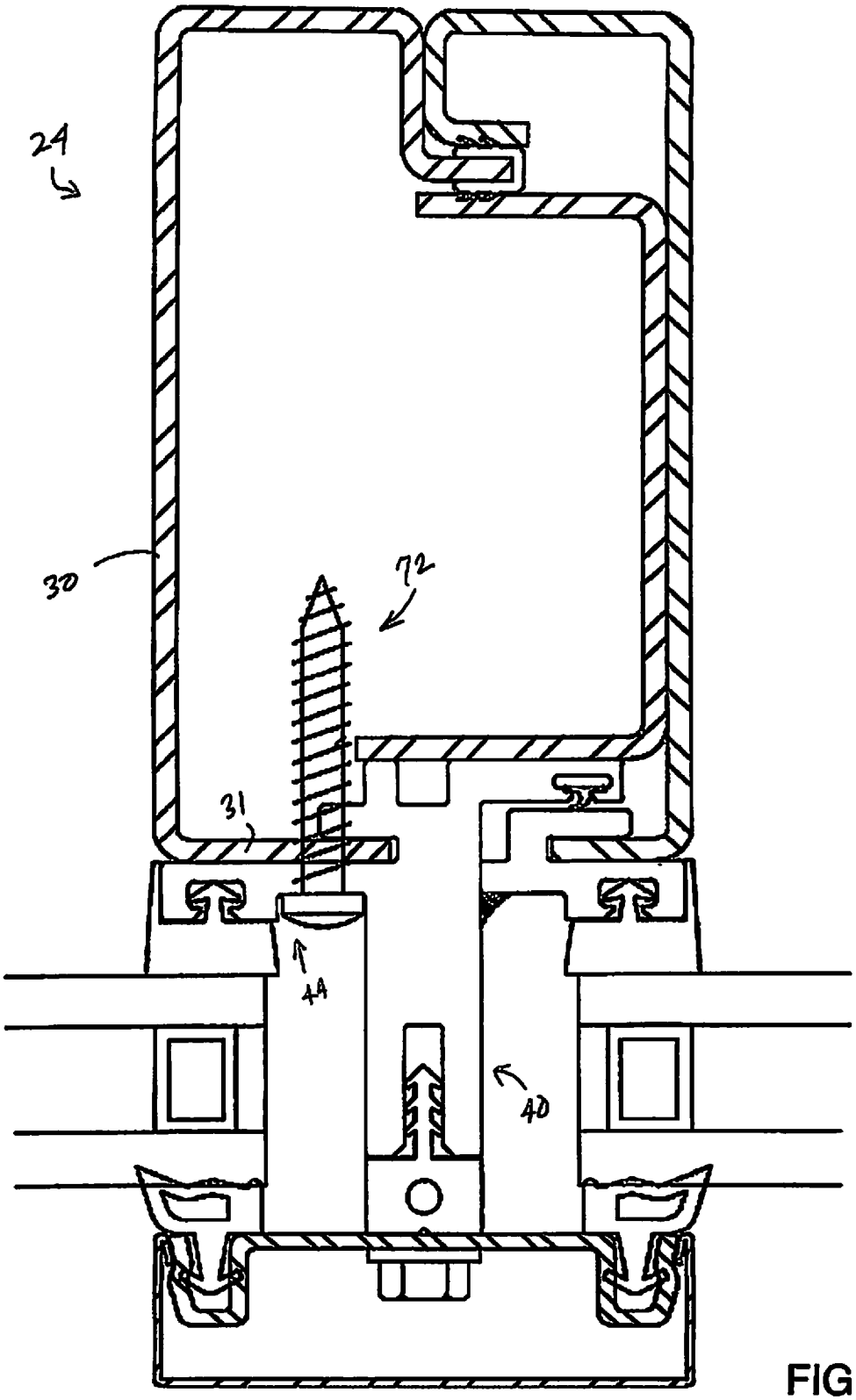
FIG. 6 is a sectional view of a mullion along line 2-2 of FIG. 1, according to some further embodiments.

With reference to FIG. 6, an alternative mullion 24 which is similar to the mullion 24 of FIG. 2 further includes a fastener 72 such as a screw. Fastener 72 includes additional support to further inhibit separation of polymer component 40 from mullion 24. In one aspect fastener 72 is positioned through first arm 44 of polymer component 40 and through tail 31 of steel segment 30. A sealant may also be inserted to cover the head of fastener 72 and to seal the opening (or edges of the opening) which is created by fastener 72. Use of fastener 72 provides enhanced protection in the event of a fire situation where temperatures can be extreme. It is envisioned that the bonding of polymer component 40 (and shoulder 70) will withstand very high temperatures without separation and/or with use of fastener 72 such separation will be inhibited or prevented. Polymer component 40 is made of fire retardant material. Accordingly, the features presented in FIG. 6 provide a mullion with an enhanced fire rating.

Figure 7:
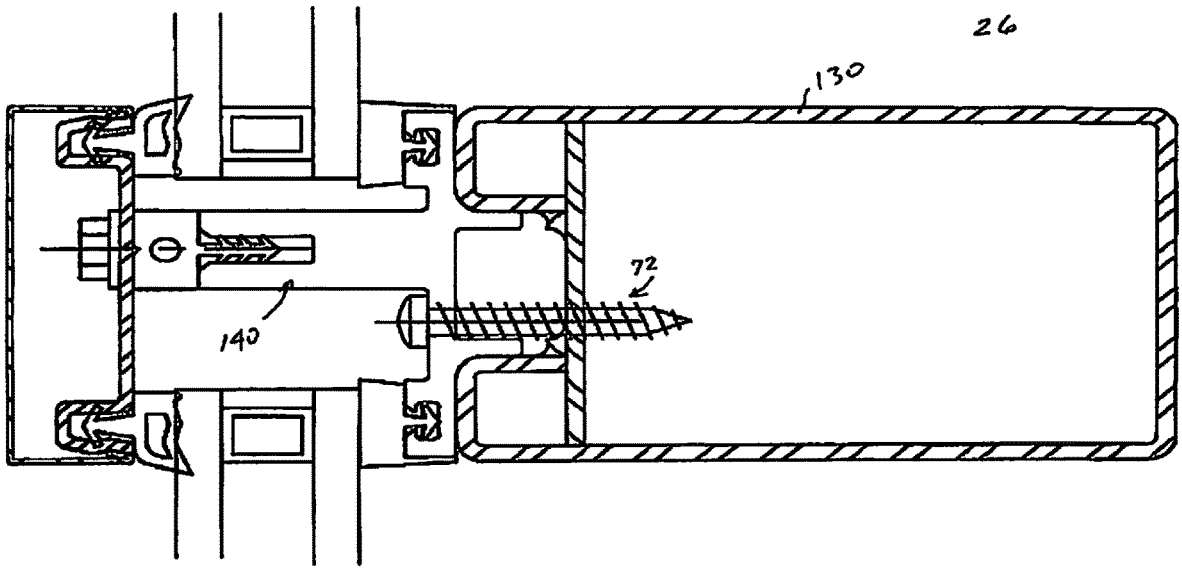
FIG. 7 is a sectional view of a transom along line 3-3 of FIG. 1, according to some further embodiments.

FIG. 7 shows transom 26 where fastener 72 is inserted through polymer component 140 where polymer component 140 is also bonded to transom 26. This arrangement has similar separation inhibiting aspect as noted with FIG. 6.

Figure 8:
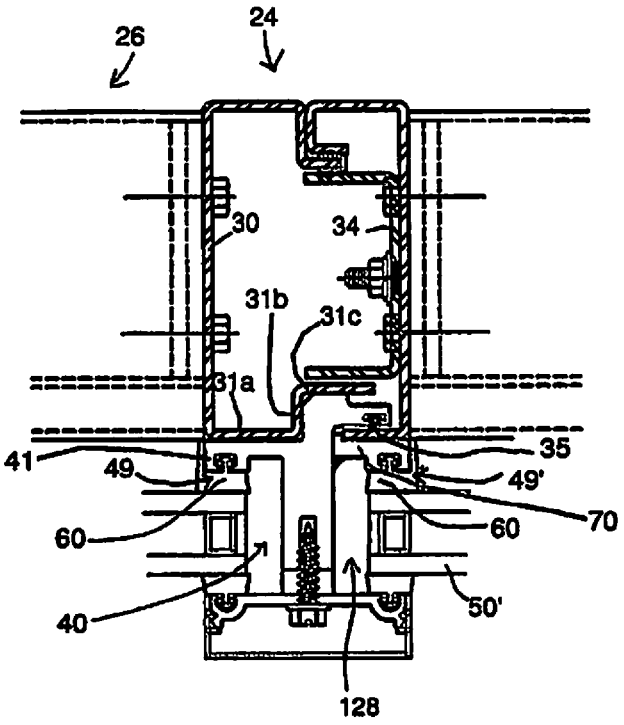
FIG. 8 is a sectional view of a mullion along line 2-2 of FIG. 1, according to some further embodiments.

FIG. 8 shows a polymer component 40 bonded to mullion 24. In this aspect mullion includes first mullion segment 30 having a tail 31*a* leading to arm 31*b* and hand 31*c*. Arm 31*b* extends from tail 31*a* in a generally perpendicular orientation. Hand 31*c* extends from arm 31*b* in a generally perpendicular orientation. Component 40 is bonded to segment 30 at tail 31*a*, arm 31*b* and hand 31*c*. Mullion 24 also includes second mullion segment 32 which includes shoulder polymer component 70. Component 70 is made of the same or similar material as component 40. Component 70 is bonded to segment 32 at tail 35. It may be appreciated that the exterior surface of tail 35 is covered from the atmosphere or from communication with panel 50' or pocket 128. It may also be appreciated that the exterior surface of segment 30, such as at tail 31*a*, arm 31*b* and hand 31*c*, is also covered from the atmosphere or from communication with panel 50 or pocket 128. Component 70 may wrap at least in part at a tip of tail 35. Component 40 and component 70 include seal receiver 49, 49' to receive respective seals 60.

Figure 9:
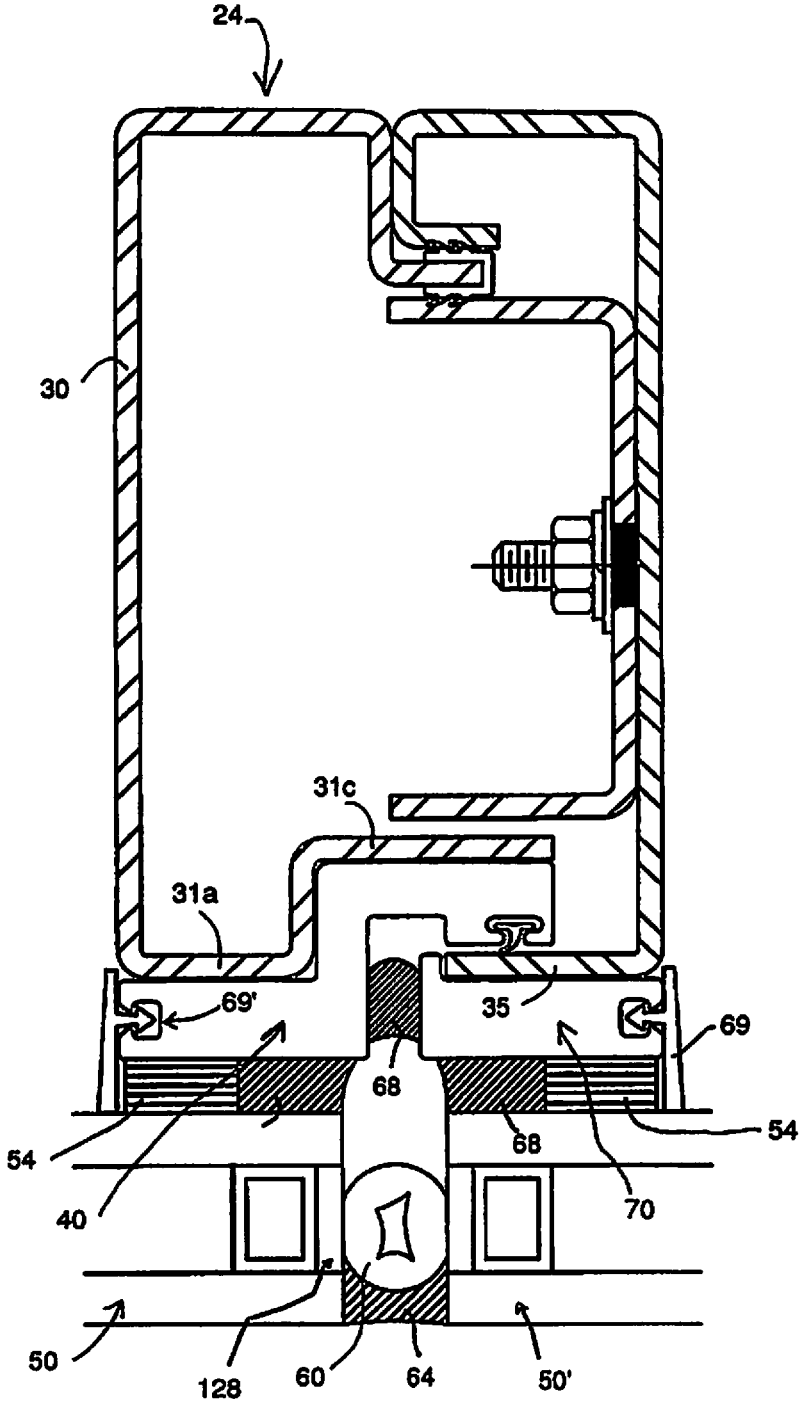
FIG. 9 is a sectional view of a mullion along line 2-2 of FIG. 1, according to some further embodiments.

FIG. 9 shows a polymer component 40 and a polymer component 70 bonded to mullion 24. The bonding is achieved by use of an adhesive applied. In this aspect component 40 is devoid of a stem and does not include an element which projects into pocket 128. Panels 50, 50' are secured to component 40 and component 70, respectively, with glazing tape 54 and structural silicone 68. A sealant 64 and seal 60 are applied between panels 50, 50'.

Figure 10:
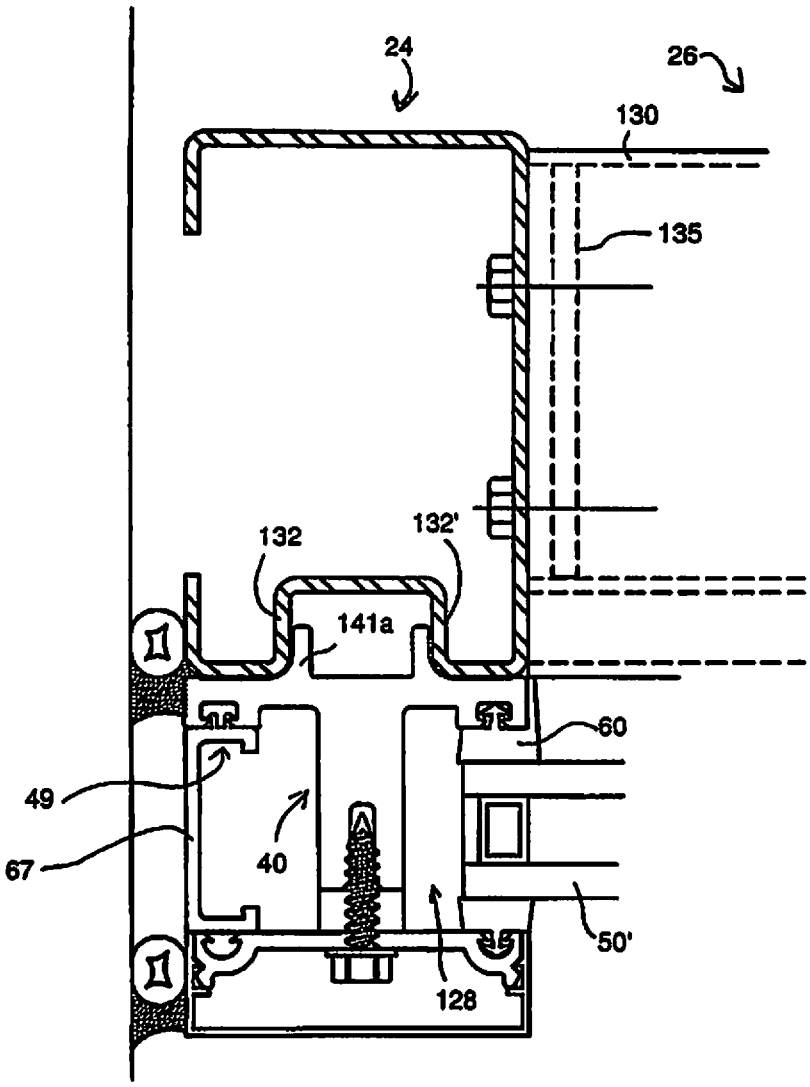
FIG. 10 is a sectional view of a mullion positioned along an end wall of FIG. 1, according to some further embodiments.

FIG. 10 shows a polymer component 40 bonded to mullion 24. In one aspect mullion 24 is formed of bent sheet steel. In this view mullion 24 is positioned adjacent or against a vertical wall and connects with a transom 26 having wall 130. Transom 26 also includes an end plate 135 welded at an end of transom 26. End plate 135 receives fasteners which pass through mullion 24. A single segment mullion 24 is configured with opposing walls 132, 132' to accommodate adherence of fingers 141*a*, 141*b*. Segment 40 is bonded to mullion 24 as noted above with respect to the further aspects. Segment 40 includes seal receivers 49, 49' to receive a seal 60 and/or a PVC spacer 67. It may be appreciated that an entirety of an outside surface of mullion 24 is isolated from the atmosphere or from communication with panel 50' and/or pocket 128. It may be appreciated that panel 50' may also be fastened to mullion 24 by use of glazing tape and silicone gasket as desired (and as an alternative to use of a fastener and/or stem 80).

While there are some curtain wall systems made of metal, most are made of aluminum. Some curtain wall installers may not appreciate the difficulties in working with steel systems due to the need to assure non-exposure of parts to the atmosphere or water which would otherwise result in deterioration, or for other reasons (or if they do, the exactness of the installation may require extra time and expense to complete the project). A tradesman accustom to installing aluminum systems might be more apt to make a mistake in dealing with steel, or if a mistake is made, the resulting damage is, or can be, much more significant as compared to a mistake in installing an aluminum system.

Accordingly, use of a system where the fiberglass reinforced polymer elements act as the stem and/or cover the face side of mullion 24 (or transom 26) is desired. It would not matter if an installer would be concerned about confronting a steel mullion structure as opposed to an aluminum structure since either may be configured to prevent exposure of the frame element (while also providing improved insulating aspects).

Mullion 24 may be of varying lengths depending on the desired application. In one example, mullion 24, and thus segment 30 may have a length of up to 24 feet, or at least 24 feet. A press that is 24 feet long, or at least 24 feet long may be used to form mullion 24 at such length. Mullion 24 may also be of smaller length as desired and smaller presses and tooling may also be used. Mullion 24 may be formed at a variety of widths. In one example mullion 24 may vary in width from 1¾ inches (45 mm), for instance, to 4 inches (100 mm) or more, and may vary in depth from 4 inches (100 mm), for instance, up to 16 inches (405 mm) or more. Different lengths, widths and depths and other dimensions may also be used as desired.

All of such variously dimensioned mullions and transoms and individual segments can be manufactured using the same tooling and break press machine in a bending process. In another example mullion and transom may be manufactured using a roll forming technique. In a roll forming technique different tooling would be used to manufacture mullions or transoms having different dimensions. By utilizing the same break press machine and tooling, however, a variety of dimensions with custom or various profiles may be formed at lower cost. Steel cannot be extruded, or is extremely difficult or impossible to extrude with present or typical machinery or methods. Bending of steel is used to provide the profile as shown in the Figures, for example.

The bending of steel by use of a press brake and tooling to make curtain wall components or segments as presented at such lengths and tolerances has heretofore never been done before or even appreciated as being capable of accomplishment (despite a long-felt need in the market). This is remarkable especially due to the complexities, uncertainties and difficulties given the need for particular tolerances and lengths of products and equipment, together with the difficulties in handling the products and the precise nature required for creating the products and associated equipment. Until the present invention there has been a lack of appreciation of the opportunity to utilize press-brake bending of steel for creating curtain wall segments. Press break bending has not been utilized for creating curtain wall products having lengths of 24 feet, or even greater than 20 feet. Applicant appreciates the difficulty in obtaining or maintaining required tolerances along the entire length of the segments, for instance, the need to have clean or complete folds or bends (which also avoid facture or cracking during forming) that run uniformly along the entire profile length of the lengthened steel products. An added benefit of using a press brake forming process under the invention is that the steel curtain wall segments may be customized to accommodate different depths or other dimensions (while still maintaining desired tolerances and long lengths) without having to purchase or design new equipment or tooling.

A method aspect of the invention includes bending sheets of steel to make a variety of curtain wall mullion or transom segments and bonding a fiber reinforced polymer element to the structure such that the bonded element extends into a gap defined by two adjacent panels supported by the system. The method includes using a press brake and a set of tooling elements configured for use in conjunction with the press brake to bend a sheet of steel to form a first mullion segment. The bonded segment has a polymer component. The method further includes using the press brake and at least some of the same tooling elements (or all of the same tooling elements) to bend a second sheet of steel to form a second mullion segment. The bonding process may include use of adhesives and curing agents and application of temperature or other bonding techniques to assure a rigid formation of the polymer component to the mullion or transom structure.

A further aspect of the invention includes a method of making a thermally insulating component configured to be bonded to a metal structure where the method comprises pultruding the component with a thermally insulating material through a pultrusion die having a profile perpendicular to the direction of pultrusion including a stem 80 extending in a first direction from a base 81, first arm 144 and second arm 146 extending from opposite sided of base 81 and each extending perpendicular to the stem 80 and each defining a seal receiver 149 having an opening toward the first direction. In a further aspect the stem 80 includes a groove 82 configured to receive a fastener 39. Groove 82 may include a taper 84 to assist in receiving fastener 39. Groove 82 may be a continuous groove which spans the length of component 40, 140. It may be appreciated that groove 82 operates as a pilot hole to receive and contain fastener 39. In one aspect groove 82 is configured to securely receive a fastener such as a screw, including a #14 stainless steel HWH SMS screw. In a further aspect the component profile includes a first finger 141*a* and a second finger 141*b* each extending from base 81 opposite stem 80. Fingers 141 are configured to align with a curve of metal structure 26, and particularly configured to conform to opposing hands 132, 132'. While other arrangements are available, in one aspect fingers 141 are symmetrically separated by a distance greater than the width "w" of stem 80. The thermally insulating component 40 may be pultruded from fiberglass material, and may also include reinforcing mats and an exterior surface may include a heat set resin coating. In further aspects the invention includes the method of pultruding the various thermally insulating components 40, 140 (and components 70, 170, 270) as described herein.

A further aspect of the invention includes a method of bonding a thermally insulating component to a metal structure. The metal may include steel, aluminum, alloys or other metals. In one aspect the method includes providing an adhesive between a pultruded fiberglass material and an outer side 125 of metal structure 26. In one aspect the fiberglass material is a polymer component 40 having fingers 140 that fit with respective hands 132 of the metal structure 26. In further aspects the method includes bonding the component 40 to the cover the entirety of the outer side 125 of metal structure 26.

Figure 11:
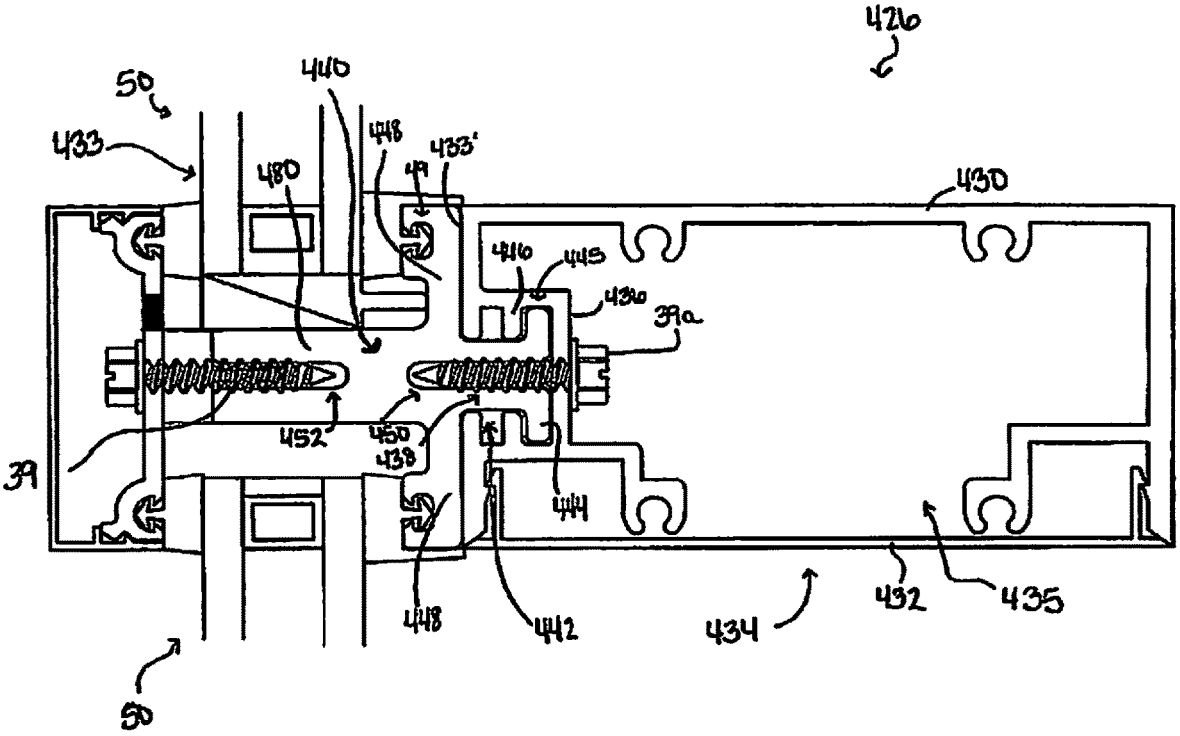
FIG. 11 is a section view of a transom according to some further embodiments.

FIG. 11 is a section view showing a further aspect of the invention. Transom 426 is a metal structure and includes a metal first segment 430 and a metal second segment 432 connected thereto. Segments 430, 432 may be made of extruded metal such as aluminum. Segment 432 may snap-fit into connected position. Transom 426 has an outer side 433 which is oriented toward or facing panels 50 or an outside of the building to which transom 426 is connected. Segment 430 includes an access port 434 such that when segment 432 is not connected to segment 430, access is made available to inside 435 of transom 426. Particularly, access may be made through port 434 such that a fastener 39 may be inserted into and through segment 430. Fastener 39 may be inserted such that a head 39*a* of fastener 39 abuts inner surface 436 of transom 426. In one aspect fastener 39 is inserted through segment 430 to outer side 433 of transom 426.

Transom 426 includes a component 440 connected to transom 426 at outer side 433. Component 440 may be made of materials noted above regarding components 40, 140. In one aspect component 440 includes a head 442 which inserts into a pocket 438 of segment 430. Head 442 may include ear or ears 444 which in one aspect insert into interlocking slots 445 defined at least in part by pocket rib 446. Component 440 also includes shoulder 448 or opposing shoulders 448 which abut transom 426 at outer side 433. Particularly, shoulder 448 abuts and covers outer side face 433' of segment 430. It may be appreciated that component 440 abuts and covers the entirety or substantially the entirety of outer side 433 of segment 430. Covering the entirety of outer side 433 isolates the metal transom 426 from the outside and insulates transom 426. Component 440 also defines a bore such as head bore 450 which is configured to receive fastener 39. Head bore 450 opens toward head 442 such that fastener 39 penetrates through segment 430 and into bore 450. Bore 450 is a closed bore in that bore 450 is closed opposite head 442 (i.e., the bore does not run through the component). In this manner component 440 may be fastened to transom 426 without exposing any part of transom or outer side 433 to the elements. There are no perforations made through component 440 which would otherwise tend to cause moisture or cold or outside air to contact transom 426. Bore 450 also allows for efficient insertion or securing of fastener 39 to component 440. Given the nature of the materials used to make component 440, such as in one instance component 440 is made of reinforced fiberglass, bore 450 allows the fastener 39 to penetrate or connect to component 440 without undue trauma to component 440. The absence of bore 450 might otherwise cause component 440 to splinter or crack or otherwise become weak when fastener 39 is inserted. In one instance fastener 39 includes self-threading threads which impart corresponding thread grooves in component 440 at bore 450. Opposite from bore 450 is stem bore 452 defined by stem 480. Bore 452 receives a fastener 39. Fastener 39 may secure pressure plate to transom 426. Bore 452 opens outward and has a closed end or bottom oriented toward segment 430. Shoulder 448 may include a seal receiver 49 to receive a seal 60. Seal 60 abuts panel 50. A spacer or setting block 37 is positioned on component 440 at stem 480. Upon block 37 rests panel 50. It may be appreciated that panel 50 will have a weight and the weight is supported by component 440. Component 440 extends between or into a gap between panels 50, 50. In this manner component 440 is a structural support of panel 50. It may be appreciated that component 440 may extend the entire length or substantially the entire length of the face or outer side 433 of segment 430.

In one aspect component 440 is positioned within pocket 438 of segment 430 by longitudinally inserting head 442 into pocket 438 and sliding component 440 longitudinally within pocket 438. Component 440 and segment 430 may be placed end-to-end for sliding action. Once head 442 and component 440 are slid into position within pocket 438, a fastener 39 or series of fasteners may be secured to transom 426. Particularly, a fastener 39 is positioned to inside 435 and placed against inner surface 436. A drill or screw driver is activated to drive fastener 39 through segment layer 430 and into bore 450 of head 442 of component 440. A series of fasteners 39 may be inserted along the longitudinal aspect of component 440. Fasteners 39 may be inserted via angled drill/drive devices. Fasteners 39 may be inserted robotically. After insertion of fasteners 39, second metal segment 432 is connected to first metal segment 430 to form transom structure 426. In a further aspect, component 440 may also be bonded to metal segment 430. In one instance shoulder 448 may be bonded to outer side face 433' with an adhesive. A heat treatment may also be applied to assist with the bonding. An adhesive layer may also be inserted into or used to fasten shoulder 448 to segment 430. Adhesive may also be used to secure head 442 within pocket 438. Various designs and configurations of head 438 may be used.

In further respects an aspect of the invention includes the component 440 itself. Component 440 is a thermally insulating fiberglass reinforced polymer component 440. Component 440 is for use with a curtain wall mullion 426 or transom of a curtain wall system. In one aspect component 440 includes a head 442 configured to insert into a pocket 438 defined at an outer side 433 of a metal mullion or transom 426 of the system. Opposing shoulders 448 define seal receivers 49 configured to receive a seal oriented to abut a panel 50 of the system. Each of the shoulders 448 are configured to about the outer side 433 of the metal structure 426 such that component 440 covers substantially an entirety of the outer side 433. As shown in FIG. 11, component 440 covers the entirety of the outer side 433 at outer side face 433'. A stem 480 is configured to project into a space between a first panel 50 and a second panel 50 of the system. Stem 480 provides structural support of the panel 50. Component 440 comprises a unitary thermally insulating fiberglass reinforced polymer. In further aspects component 440 comprises pultruded fiberglass reinforced polymer. The head 442 defines a head bore 450 configured to receive a fastener 39 inserted through the metal structure 426 and into the component 480. In further aspects, stem 480 defines a stem bore 452 configured to receive a fastener 39. The fastener 39 received in stem bore 452 may be of a different, or the same, variety as the fastener received at head bore 450. Stem bore 452 in one aspect is oriented opposite head bore 450.

Figure 12:
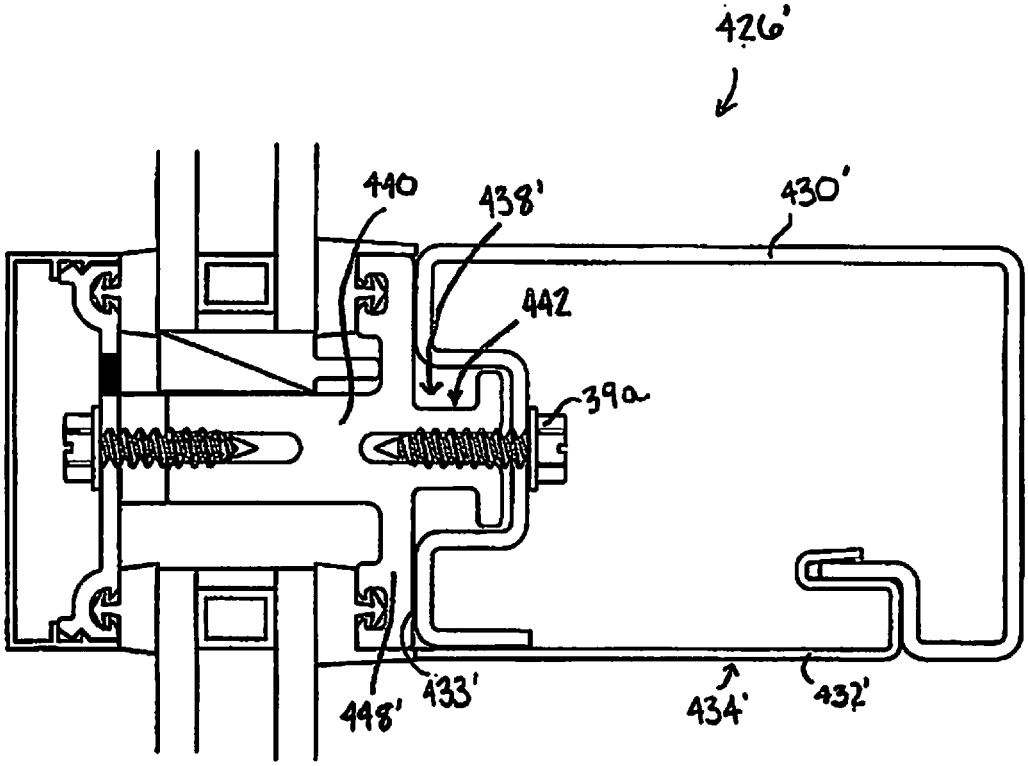
FIG. 12 is a sectional view of a transom according to some further embodiments.

FIG. 12 is a section view of a further aspect of the invention. Transom 426' is a steel transom having a steel first segment 430' and a metal second segment 432' which may also be made of steel. Segment 432' may slide into connected position and friction fit into secure placement. Access port 434' is used to insert fastener 39 through segment 430' and into component 440. Shoulder 448' is connected to outer side face 433. An adhesive and heat and pressure techniques may be used to secure or bond shoulder 448' to outer side face 433'. An adhesive layer may be inserted between shoulder 448' and face 433'. Fastener 39 is inserted from within segment 430. Several fasteners 39 may be inserted though segment 430 to secure component 440 along the longitudinal length of segment 430'. It may be appreciated that with the design of pocket 438' (which lacks ribs 446), head 442 of component 440 may be inserted by translating component 440 into the pocket 438' and without requiring a longitudinal sliding action.

Figure 13:
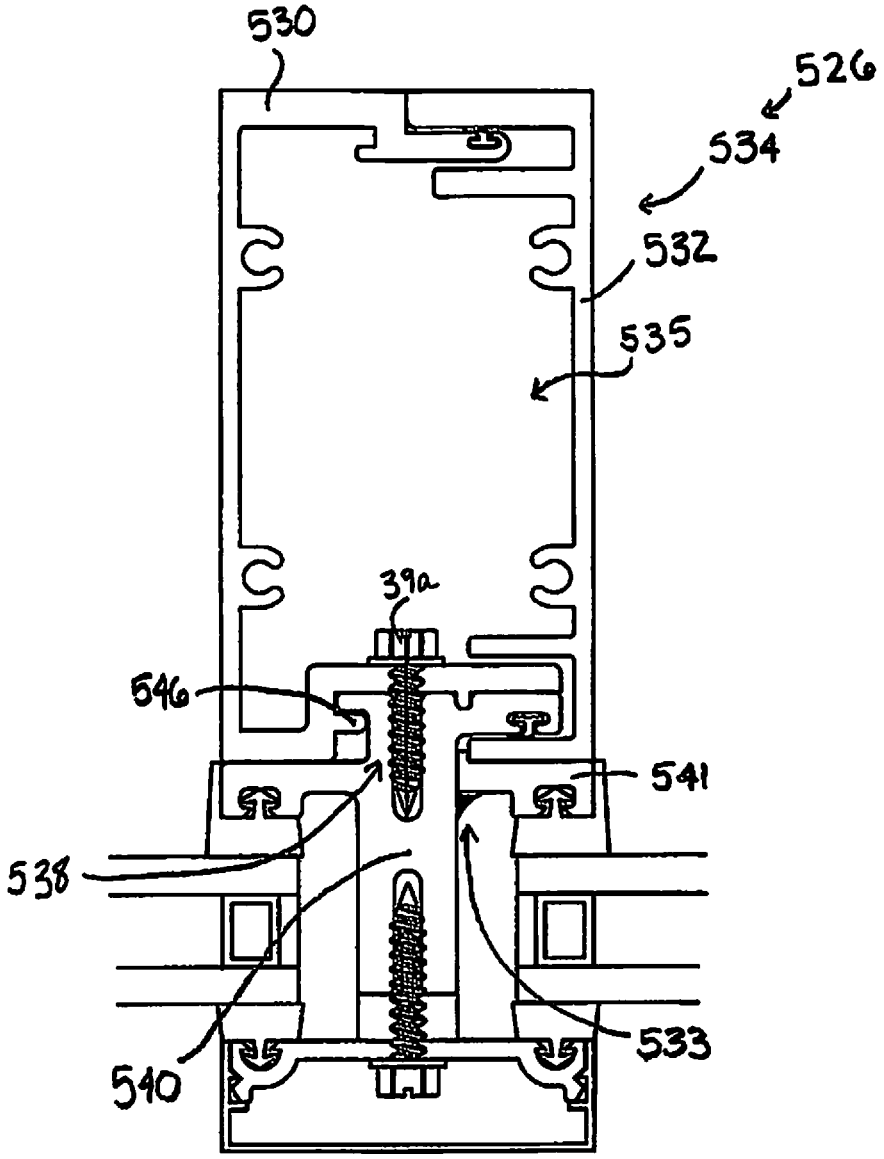
FIG. 13 is a section view of a mullion according to some further embodiments.

FIG. 13 is a section view of a further aspect of the invention Mullion 526 is an aluminum mullion having first segment 530 and a second segment 532 connected thereto. Fastener 39 may be positioned at inside 535 of mullion 526 and driven through wall of segment 530 into component 540. Component 540 includes a head which inserts into pocket 538. Pocket ribs 546 may be used as interlock elements to assist in locking component 540 or aligning component 540 within pocket 538. An additional component 541 may also be connected to segment 532 such that together component 540 and component 541 cover an entirety or substantially the entirety of outer side 533 of mullion. Component 541 may be made of the same or similar material used to make component 540, and in one aspect is a fiberglass reinforced polymer and in further aspect is an insulating pultruded fiberglass reinforce polymer.

Figure 14:
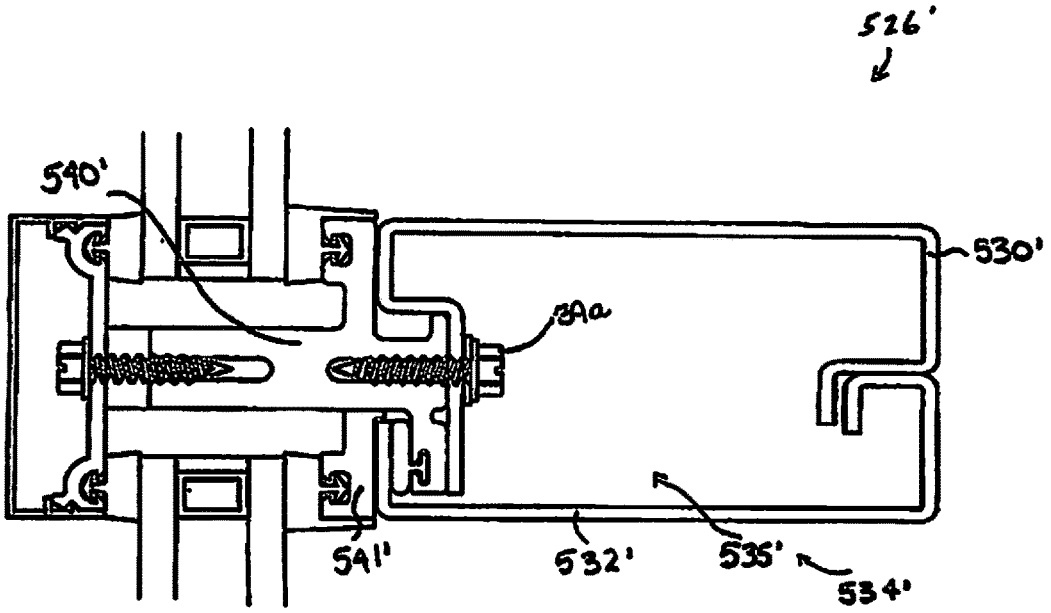
FIG. 14 is a section view of a mullion according to some further aspects.

FIG. 14 is a section view of a further aspect of the invention. Mullion 526' is a steel mullion having a first segment 530' and a second segment 532' connected thereto. Second segment 532' may also be made of steel. Component 540' is secured to segment 530' with a fastener 39. An optional washer may be placed between fastener 39 and the inner surface 536 of segment 530'. An optional washer may also be used with the other aspects described herein. A second component 541' may be connected to segment 532'. Component 541' may be bonded to segment 532'. Second component 541' may also be connected to segment 532' with a fastener which runs from inside 535' of mullion 526 through a wall of transom segment, either 530 or 532, and into component 541.

Figure 15:
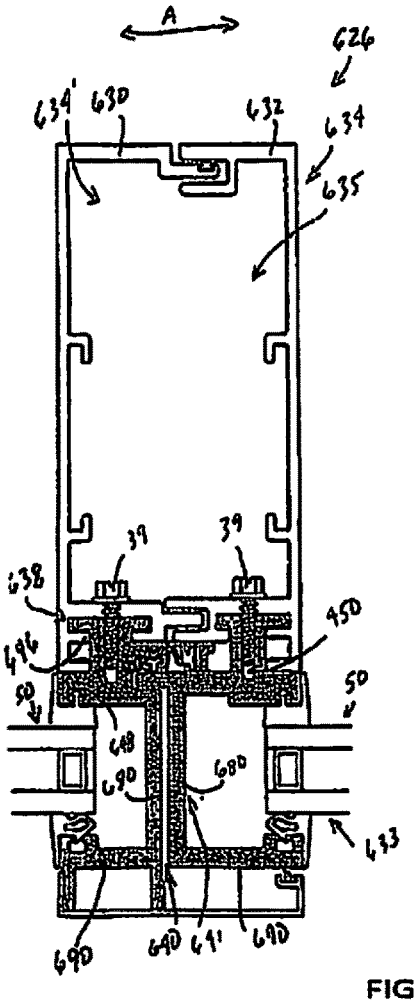
FIG. 15 is a section view of a mullion according to some further aspects.

FIG. 15 is a section view of a further aspect of the invention. Mullion 626 includes a metal segment 630 and a second metal segment 632 which slide together for an adjustable connection. For instance, segments 630, 632 may slide relative to each other in the direction of arrow A to form a mullion 626. A fastener 39 inserts from inside 635 of segment 630 through a wall of segment 630 and into component 640. Component 640 may be made of a polymer material as noted herein. Component 640 is connected to segment 630 by fastener 39. Interlock rib 646 may be used to form an interlock to secure component 640 within a pocket 638. Component 640 is slid longitudinally into pocket 638 to be secured to segment 630 and/or secured via fastener 39 and/or both. An adhesive may also be used to secure component 640 to segment 630. An adhesive bonding may be used together with a fastener and also together with an interlock as desired. As shown in FIG. 15, a rib or ribs and pocket similar to rib 646 and pocket 638 may also be provided by segment 632 to secure component 641. An interlock and/or fastener 39 and/or both and or adhesive and/or all of such connections may be used to connect component 641 to segment 632. An adhesive may also be used, including an adhesive layer together with heat and pressure treatments used to bond or secure component 640, 641 to mullion 626.

Component 640, 641 includes stem 680 which extends between panels 50. A leg 690 wraps laterally and over (and covers) a portion of panel 50 as shown. A portion of panel 50 is also covered by shoulder 648. Shoulder 648 and leg 690 each define a seal receiver 49. Component 640 may be secured to segment 630 using several fasteners 39. Thereafter panel 50 may be secured using component 640 and with seal placed in seal receivers 49 and adhered to panel 50. Likewise, component 641 may be fastened to segment 632 with several fasteners 39 and then panel 50 connected to component 641 by use of seals and adhesive. Segment 630 and segment 632 may then be slid or adjustably connected together. The segments 630, 632 may also be conveniently disconnected by relative sliding along direction of arrow A. When segments 630, 632 have been connected together, mullion 626 may be connected to the building structure. It may be appreciated that an entirety or substantially the entirety of outer side 633 of combined segment 630, 632 (or of individual segments 630, 632) is covered by components 640, 641 with portions of components 640, 641 contacting segments 630, 632. Further, it may be appreciated that no pressure plate or exterior fastener is required to secure panel 50 to segments 630, 632. In one aspect, components 640, 641 comprise pultruded fiberglass polymer and are configured to wrap about the edge of panel 50. Components 630, 632 define bore 450 to receive fasteners 39.

Figure 16:
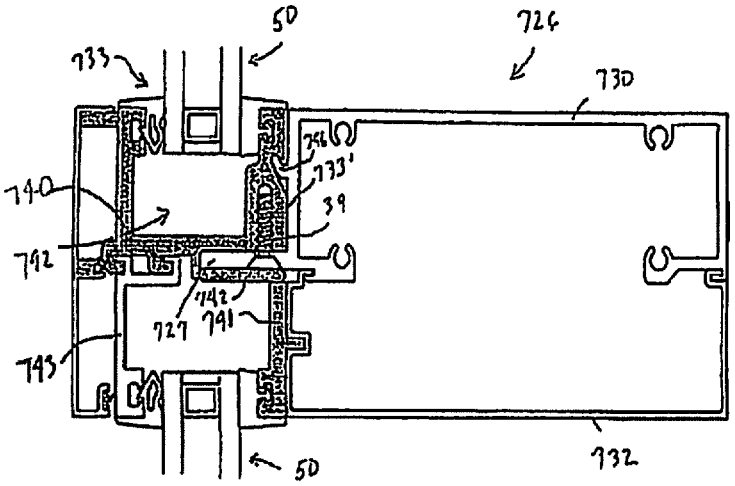
FIG. 16 is a section view of a mullion according to some further aspects.

FIG. 16 is a section view of a further aspect of the invention. Transom 726 includes metal segment 730 and metal segment 732 connected thereto. A wing 727 projects from segment 730 to a gap between panels 50, 50. Fastener 39 is secured through wing and into component 740. Component 740 may include a bore to receive fastener 39. In one aspect wing 727 projects perpendicularly or generally perpendicularly from outer side face 733'. In one aspect, fastener 39 is oriented perpendicular or generally perpendicular to wing 727. Component 740 may be a polymer component as described herein. A second component 741 is connected to segment 732. Component 741 may be connected via adhesive or bonding. A fastener may also be secured from and through inside of segment 732 and into component 741. In further aspects component 741 may include a bore to receive a fastener. Component 740 wraps around to both sides of panel 50 as shown. An entirety of outer side 733 of combined segment 730, 732 is covered by components 740, 741, 742. Such components 740, 741, 742 also contact outer side 733 of segments 730, 732. Component 741 may include an interlock which inserts into a corresponding interlock of segment 732. Component 741 may also include a seal receiver which receives a seal to abut against panel 50. An additional component 742 may be used to cover wing 727 as shown and to provide further insulating protection of segments 730, 732. Component 742 may be connected to wing 727 by adhesive and/or a fastener. A further component 743 includes a seal receiver and receives a seal to abut against panel 50. Component 743 may comprise a metal or in other aspects may also comprise a fiberglass component. An end of component 743 opposite seal receiver includes a rib or ribs which insert into corresponding rib or ribs of component 740 for secure positioning of component 743. In addition to use of fastener 39, or as an alternative to fastener 39, an adhesive may be used to rigidly bond component 740 to outer side face 733'. Such bonding may be made by use of an adhesive and other forms of bonding may also be used. Additionally, or alternatively, a rib 746 may also be used to secure or assist in rigidly securing component 740 to face 733'. A spacer may be inserted into cavity 792 of transom 726 so that panel 50 may rest against the spacer so that the weight of panel 50 may be supported by component 740. Component 740 may also include a weep hole or weep holes to allow moisture to escape from cavity 792.

Figure 17:
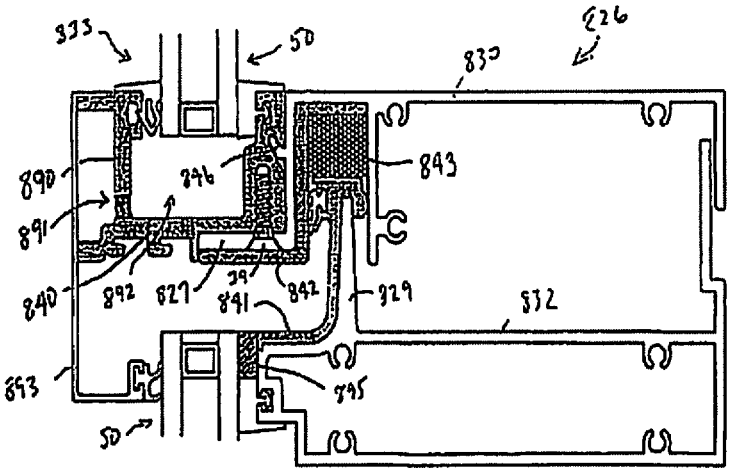
FIG. 17 is a section view of a transom according to some further aspects.

FIG. 17 is a section view of a further aspect of the invention. Transom 826 includes metal segment 830 which may be aluminum for instance. Segment 830 mates with segment 832 which may also be made of metal such as aluminum. Component 840 is connected to outer side 833 of transom 826. In one aspect component 840 connects to wing 827 and is configured to cover the entire outer side of segment 830. Component 840 may include a bore configured to receive fastener 39 inserted through wing 827. An adhesive may also be used to secure component 40 to segment 830. A strip or sheet of double back adhesive may be used. Heating, pressure and additional bonding techniques may be used to connect a component to the metal herein. Various interlocks, ribs and grooves may also be used to secure component 840 to segment 830. Segment 830 may include a rib 846 or ribs which mate with component 840 for interlocking arrangement. Component 840 may include leg 890 which extends to an outer side of panel 50 and transom 826 and may include a seal receiver to receive a seal to abut against panel 50. Component 840 may also include a weep hole 891 or a series of weep holes to allow moisture to escape from cavity 892. Component 840 includes a further seal receiver to receive a seal to abut panel 50 on an inner side of panel 50. It may be appreciated that component 840 wraps around to both sides of panel 50. A spacer may also be positioned in cavity 892 so that panel 50 may rest upon the spacer which in turn rests upon component 840. Component 840 supports the weight of panel 50.

A component 841 is connected to segment 832 at jaw 829. The entirety of the outer side of jaw 829 is covered by component 841. Component 841 wraps around a tip of jaw 829. Component 841 includes a seal receiver for receiving a seal to abut against an inside of segment 830. An optional air baffle 843 is placed within segment 839. In one aspect baffle 843 may be about 4 inches in length and is positioned where the vertical mullion terminates or at the top of the vertical mullion to prevent air leaks. In one aspect baffle 843 fits snugly into a channel defined in part by various walls of segment 830 as shown. A tip of jaw 829 inserts into the channel and the component 841 abuts baffle 843 which also seals outer face of segment 830 from exposure. Segment 842 is also connected to segment 830 and covers wing 827 and isolates wing 827 and walls of segment 830 from the atmosphere or exposure. It may be appreciated that components 841, 842 may be secured to segments 830, 832 by adhesive, including a double backed strip adhesive and under pressure and temperature for bonding. In alternative aspects components 841, 842 may also be fastened with a fastener. Components 841, 842 may also define respective bores for receiving fasteners. Components 840, 841, 842 may be secured by use of adhesive and/or fasteners and/or interlock/friction fit or all of the same. An end cap 893 connects securely to component 840 via friction fit or snap-n fingers and includes a seal receiver and seal to abut panel 50 which is held in place at panel 832. An adhesive block or connector 895 is used to secure panel 50 to segment 832. It may be appreciated that segment 830 and 832 come together to form transom 826 and the individual segments 830, 832 are connected to respective structure elements of the building to secure transom 826 and panels 50 into position. While the unitized design shown in FIG. 17 depicts a transom made of metal such as aluminum, it may be appreciated that such transom structure may also be made with steel, of course with some structural modifications to accommodate for the bending of the steel segments comprising the transom.

Figure 18:
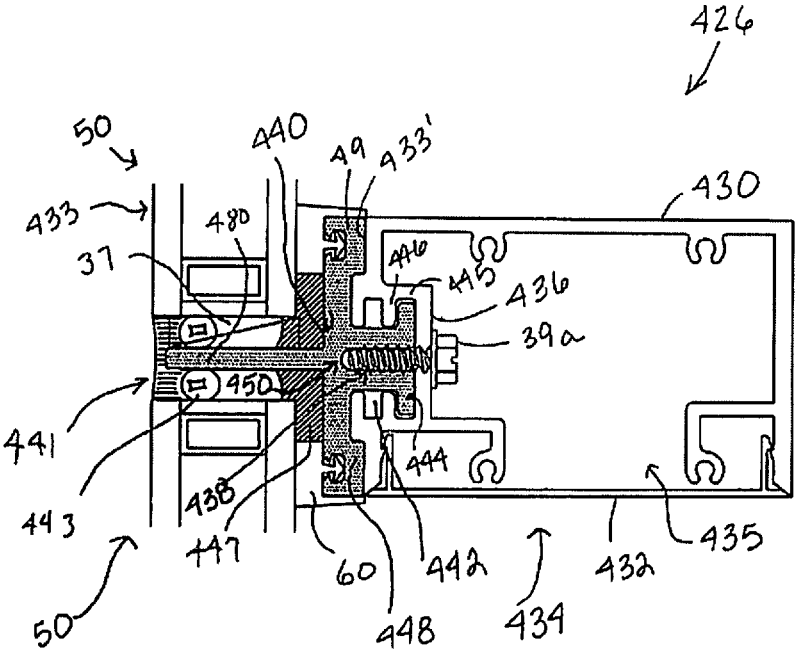
FIG. 18 is a section view of a transom according to a further aspect of the invention.

FIG. 18 is a section view showing a further aspect of the invention. Transom 426 is a metal structure and includes a metal first segment 430 and a metal second segment 432 connected thereto. The transom 426 is similar to the transom 426 depicted in FIG. 11. Transom 426 may be used in conjunction with the curtain wall systems referenced herein and/or with window well systems. Segments 430, 432 may be made of extruded metal such as aluminum. In one aspect segment 432 snap-fits into connected position. Transom 426 has an outer side 433 which is oriented toward or facing panels 50 or an outside of the building to which transom 426 is connected. Segment 430 includes an access port 434 such that when segment 432 is not connected to segment 430, access is made available to inside 435 of transom 426. Particularly, access may be made through port 434 such that a fastener 39 is inserted into and through segment 430. Fastener 39 is inserted such that a head 39*a* of fastener 39 abuts inner surface 436 of transom 426. In one aspect fastener 39 is inserted through segment 430 toward outer side 433 of transom 426, yet fastener 39 is not exposed to the atmosphere.

Transom 426 includes a component 440 connected to transom 426 at outer side 433. Component 440 may be made of materials noted above regarding components 40, 140. In one aspect component 440 includes a head 442 which inserts into a pocket 438 of segment 430. Head 442 includes ear or ears 444 which in one aspect insert into interlocking slots 445 defined at least in part by pocket rib 446. Component 440 also includes shoulder 448 or opposing shoulders 448 which abut transom 426 at outer side 433. Particularly, shoulder 448 abuts and covers outer side face 433' of segment 430. Outer side face 433' is an outward facing surface. It may be appreciated that component 440 abuts and covers the entirety or substantially the entirety of outer side 433 (or all of the outward facing surfaces) of segment 430. Covering the entirety of outer side 433 isolates the metal transom 426 from the environment outside and insulates transom 426. Component 440 also defines a bore of slot such as head bore or slot 450 which is configured to receive fastener 39. Head slot 450 opens toward head 442 such that fastener 39 penetrates through segment 430 and into slot 450. Slot 450 is a closed slot in that slot 450 is closed opposite head 442 (i.e., the slot does not run through the component from inside to outside). Slot 450 does span the entirety or substantially the entirety of the length of component 440. Because slot 450 does not run through the component 440, component 440 is fastened to transom 426 without exposing any part of the transom or outer side 433 to the elements. There are no perforations made through component 440 which would otherwise tend to cause moisture or cold or outside air to contact transom 426. Slot 450 also allows for efficient insertion or securing of fastener 39 to component 440. A user may insert fastener 39 into slot 450 at various positions along the length of component 440. Given the nature of the materials used to make component 440, such as in one instance component 440 is made of reinforced fiberglass, slot 450 allows the fastener 39 to penetrate or connect to component 440 without undue trauma to component 440. The absence of slot 450 might otherwise cause component 440 to splinter or crack or otherwise become weak when fastener 39 is inserted. In one instance fastener 39 includes self-threading threads which impart corresponding thread grooves in component 440 at slot 450. Shoulder 448 includes a seal receiver 49 to receive a seal 60. Seal 60 abuts panel 50. A spacer or setting block 37 is positioned on component 440 at stem 480. Upon block 37 rests panel 50. It may be appreciated that panel 50 will have a weight and the weight is supported by component 440. Component 440 extends between or into a gap between panels 50, 50. In this manner component 440 is a structural support of panel 50. It may be appreciated that component 440 may extend the entire length or substantially the entire length of the face or outer side 433 of segment 430.

In one aspect component 440 is positioned within pocket 438 of segment 430 by longitudinally inserting head 442 into pocket 438 and sliding component 440 longitudinally within pocket 438. Component 440 and segment 430 may be placed end-to-end for sliding action. Once head 442 and component 440 are slid into position within pocket 438, a fastener 39 or series of fasteners may be secured to transom 426. Particularly, a fastener 39 is positioned to inside 435 and placed against inner surface 436. A drill or screw driver is activated to drive fastener 39 through segment layer 430 and into bore 450 of head 442 of component 440. A series of fasteners 39 may be inserted along the longitudinal aspect of component 440. Fasteners 39 may be inserted via angled drill/drive devices. Fasteners 39 may be inserted robotically. After insertion of fasteners 39, second metal segment 432 is connected to first metal segment 430 to form transom structure 426. In a further aspect, component 440 may also be bonded to metal segment 430. In one instance shoulder 448 may be bonded to outer side face 433' with an adhesive. A heat treatment may also be applied to assist with the bonding. An adhesive layer and/or adhesive tape is inserted into or used to fasten shoulder 448 to segment 430 in one aspect. Adhesive may also be used to secure head 442 within pocket 438. Various designs and configurations of head 438 may be used.

Stem 480 extends outward between panels 50. A riser 37 is positioned on stem 480 to support panel 50. A weather seal 441 is applied to the gap at the exterior of the system. A seal cord 443 or cords in one aspect are positioned in the gap and between stem 480 and panels 50, 50. To assist in maintaining support of panels, a structural silicone 447 is positioned between component 440 and panel 50. A structural silicone 447 in one aspect is applied both above and below stem 480. A seal 60 such as a silicone gasket with molded corners 60 is positioned between component 440 and panel 50 and further assists in holding the panel to the component while providing a seal or barrier. The structural silicone 447 assist in maintaining panels 50 in contact with component 440.

Figure 21:
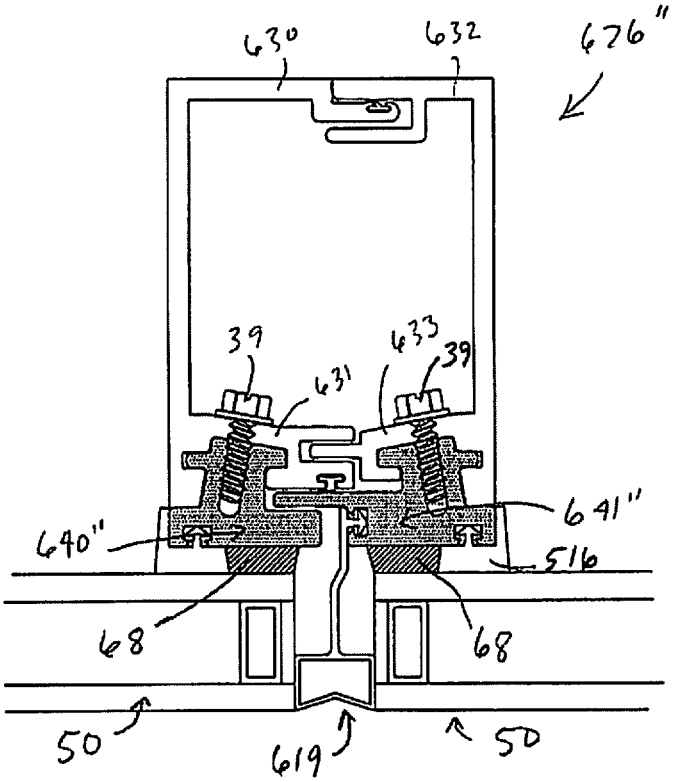
FIG. 21 is a section view of a mullion structure according to a further aspect of the invention.
Figure 19:
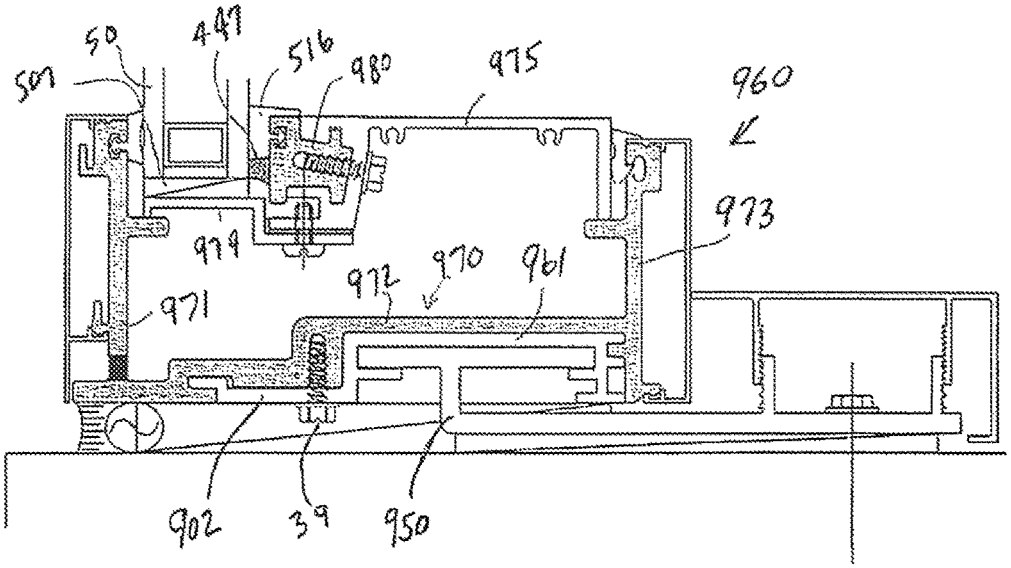
FIG. 19 is a section view of a transom structure according to a further aspect of the invention.
Figure 20:
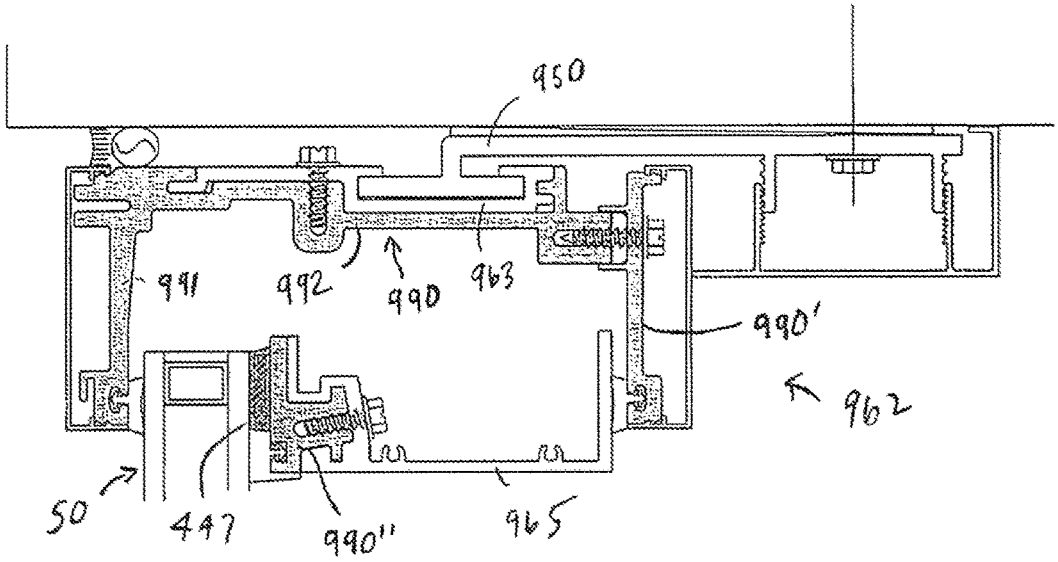
FIG. 20 is a section view of a transom structure according to a further aspect of the invention.

In further reference to FIG. 18 and with reference to FIGS. 19-21, a window wall system in accordance with one aspect of the invention is shown. FIG. 19 shows a sill of a window wall which as depicted in FIG. 20 is a corresponding header of a lower window wall system. The same panel 50 may be secured in the structure 960 at a footer or sill area and within the structure 962 at a corresponding header of the panel 50. In one aspect, structure 960 includes a frame 961 which receives or is received by anchor 950 which is fastened to the window sill (the sill operates as the header for the structure in FIG. 20). Frame 961 includes opposing hands 909 to receive anchor 950 and extends to a wing 902' which receives a fastener 39. Fastener 39 inserts into component 970 which is made of the material as noted herein. In one aspect component 970 is a thermally insulating fiberglass reinforced polymer component. Component 970 includes a generally vertical exterior portion 971, a generally horizontal frame cover portion 972 and a generally vertical interior portion 973. Exterior portion 971 is configured to receive a bottom panel holder 974 which is connected to a top panel holder 975. Bottom holder 974 in one aspects abuts against a shelf defined by exterior portion 971. Bottom holder 974 in one aspect is connected to top holder 975 with a fastener, and together the combined bottom panel 974 and top panel 975 span from the exterior portion 971 to the interior portion 973. Top panel holder 975 in one aspect abuts against a shelf defined by interior portion 973. Component 970 is a continuous fiberglass isolator and is installed in the shop. An additional component 980 is received in a pocket of top panel holder 975 and a gasket 516 and structural silicone 447 are positioned between component 980 and panel 50. Component 980 is fastened with fastener 39 positioned through top panel holder 975. A riser 507 is placed atop bottom panel holder 974 to support panel 50 as shown. Components 970, 980 operate to isolate frame 961 and other structures from the external environment. Structure 960 in one aspect is manufactured and assembled in the shop and then later applied to the window wall in the field.

FIG. 20 depicts structure 962 as applied to a header of a window wall in accordance with the invention. A frame 963 is configured to connect to anchor 950. Component 990 covers frame 963 and extends to an exterior portion 991 and includes a cover portion 992. A fastener is positioned through frame 962 and into component 990. Exterior portion 991 with gasket abuts panel 50 at an exterior surface of panel 50. An additional component 990' and a further component 990" are provided as shown. Component 990' secures to component 990 via fastener 39. A connecting panel 965 spans from component 990' toward the exterior and receives component 990" in a cavity defied by panel 965. Component 909" is secured by fastener 39. A structural silicone 447 is applied between component 990" and panel 50 to securely hold panel 50 into positon. Components 990, 990', 990" are made of the component material as noted herein. Components 990 effectively isolate frame 963 and other structures to provide an enhanced solution.

FIG. 21 is a section view of a vertical structure for use with structures 960 and 962. FIG. 21 shows a mullion 626" which is an alternative aspect of the mullion 626. Mullion 626" may also be a unitized vertical structure and does not wrap around the panels as does mullion 626. Mullion 626" includes components 640", 641" covering outward facing surfaces of metal segments 630, 632. Components 640", 641" are made of materials like the other insulating components noted herein. Various seals are positioned within or between components 640", 641" and metal segments 630, 632 and each other. Panels 50, 50 are secured to components 640", 641" with layers of structural silicone 68, for instance. Use of structural silicone 68 and/or glazing tape is sufficient to hold panels 50 without use of fasteners or wrap around structures. Silicone gaskets with molded corners 516 are also used to affix panels 50 to components 640", 641" and to achieve a desired seal. A silicone weather seal gasket 619 is positioned within a gap defined by the panels 50, 50 and secures to one of the components. Gasket 619 in one aspect is installed in the shop. For assembly, one side of the system such as the segment 632 to which is connected the panel 50 and component 641" (component 641" fastened with an inside-out fastener 39), is mated with the other side of the system such as the segment 630 to which is connected the panel 50 and component 640". In this manner several segments having associated panels may be assembled into position by simple inserting connections. In a further aspect the invention includes a panel 50 connected to a first segment 630 on one side of the panel and to a second segment 632 on an opposite side of the panel. Such panel 50 with connected segments is then connected to an adjacent or adjacent panels 50 of like variety. Successive connecting of such panels allows for efficient assembly of the system. Component 640", 641" in one aspect are slanted to correspond with slanted inner walls 631, 632. The slanted inner wall 631 accommodate ease of insertion of fasteners 39 (i.e., the slant allows for a more convenient angle to approach the fasteners for tightening), among other benefits. Preset slot are provided in components 640", 641" to accommodate for desired insertion of fasteners 39.

Figure 22:
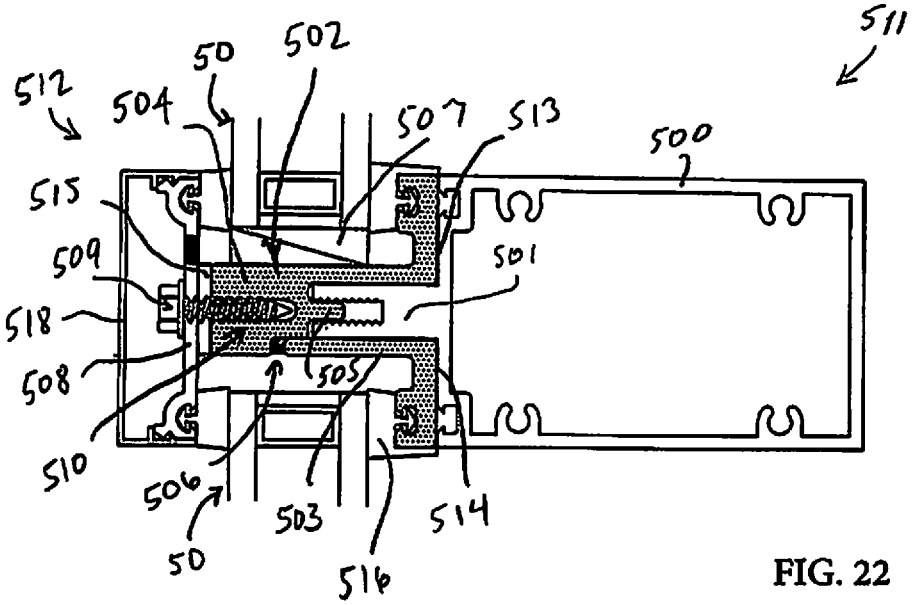
FIG. 22 is a section view of a transom structure according to a further aspect of the invention.
Figure 23:
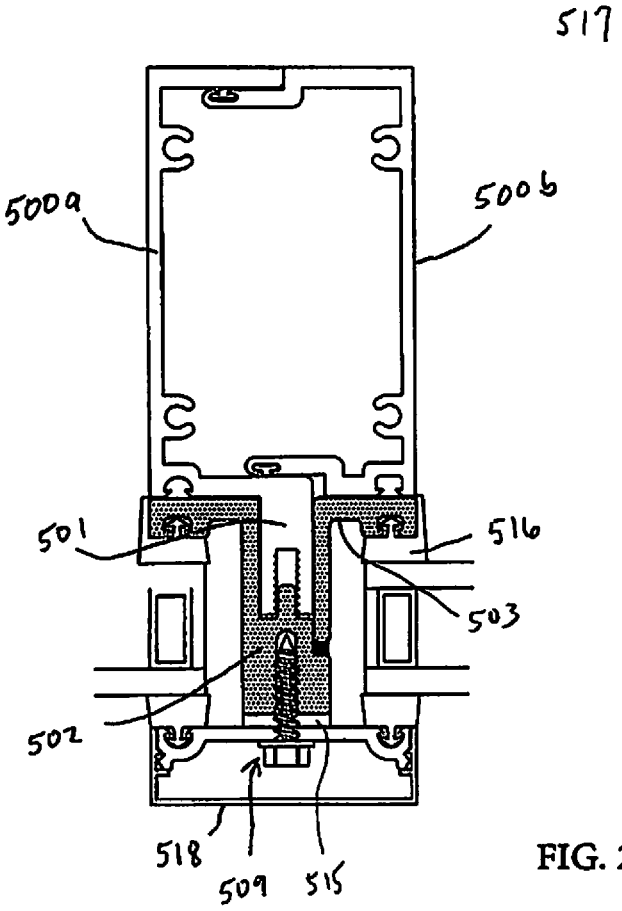
FIG. 23 is a section view of a mullion structure according to a further aspect of the invention.

FIG. 22 and FIG. 23 are section views showing further aspect of the present invention. FIG. 22 shows a structure 500 having a stem 501. Structure 500 is part of a horizontal or transom structure 511 for use in a system of the present invention and in one aspect as a retrofit solution of the present invention. Structure 500 is typically made of aluminum and is commonly used in curtain wall or window wall systems. In a typical prior art application a spacer is placed on stem 501 which in turn supports a panel 50. A pressure plate is fastened by passing a fastener through the plate and into the stem 501. Under the present invention, however, transom 511 includes the structure 500 retrofitted with a component 502 such as a thermally insulating polymer component as described herein. In one aspect component 502 is configured to cover, at least in part, at least one outward facing surface of structure 500. For instance, component 502 covers the outer side 512 of frame 500 at an outward facing surface 513. Component 502 also covers the outward facing surfaces of stem 501, and the outward facing surfaces of seal receiver. In additional aspects component 502 may also extend to cover additional outward facing surfaces of structure 500. In one aspect an additional component 503 is configured to cover, at least in part, at least another outward facing surface of structure 500. Together components 502, 503 cover or substantially cover the entirety of the outward facing surfaces of structure 500. Component 503, for instance, covers the outer side 512 of frame 500 at outward facing surface 514 and at the outward facing surfaces of seal receiver. The entirety or substantially the entirety of the outward facing surfaces of frame 500 are covered by a component. In one aspect component 502 includes a component stem 504 which projects from and over stem 501. Component 502 is bonded to structure 500. In one aspect component 502 is bonded to structure 500 by an adhesive. Other bonding mechanisms or techniques for bonding as described herein may be used. The component 502 may be bonded to stem and structure 500 in the field. For instance, in a retrofit method, an existing frame 500 may receive a fiberglass component 502 by use of adhering component 502 in the field. Component 503 may also be bonded to the frame or structure 500 in the field. Component 502 includes a stem plug 505 which inserts into the stem opening of existing stem 501. A continuous seal 506 is applied to the space between component 502 and component 503. Having separate components 502, 503 accommodates ease of retrofit application and also provides flexibility to the combined components as needed due to contraction or expansion forces that may influence the structural positioning. A riser 507 is applied between stem component 504 and panel 50 to assist in having component 504 and stem 501 bear the load of panel 50. A pressure plate 508, which may be the preexisting pressure plate of the earlier framed structure, may be used by fastening with a fastener 509 through plate 508 and into a slot 510 defined by stem component 504. Slot 510 in one aspect runs the length of component 502. A spacer gasket 515 is positioned between pressure plate 508 and stem component 504. A gasket 516 is positioned between panel 50 and component 503. Gasket 516 may be an EPDM rubber type (such as ethylene propylene diene monomer rubber, or other suitable gasket), and in one aspect has molded corners.

In one non-limiting retrofit example, the existing pressure plate, seals and panels are removed from an existing frame 500. The components 502, 503 are bonded to the outward facing surfaces of frame 500. A continuous seal 506 is applied to the space between components 502, 503. A riser 507 is provided which allows panel 50 to rest upon riser 507 and to allow stem component 504 to bear the load of panel 50. A gasket spacer 515 is positioned between a new or the prior pressure plate 508 which is secured by fastener 509 being inserted into slot 510 of component 502. Pressure plate 508 may include a weep hole to allow for vapor or fluid to escape from the gap or spaces between panels 50. An existing glass panel such as a 1 inch overall width panel having a ¼ inch clear exterior, a ½ inch air space with an aluminum spacer and a ¼ inch clear interior lite/pane is removed and replaced in the retrofit system and transom 511 with a new glass having a ¼ inch clear exterior with low-E coating (i.e., low emittance) on the inner surface (#2) with ¾ inch argon interior space with a stainless steel spacer and a ¼ inch clear interior pane, having an overall width of 1¼ inches, which provides a higher performance window and system. Use of component 502, 503 insulates the frame structure 500 from the exterior environment to provide enhanced insulation and improved performance. A component 502 having a stem component 504 which extends the reach of the previous stem 501 allows for use of a wider and more efficient panels 50. Use of the insulating components 502, 503 has substantial performance benefits in preventing exterior elements from reaching or penetrating to the frame 500 which would otherwise transfer heat/cold to the interior of the building. The combination of using the improved glass panel with the components covering or insulating the outward facing surfaces provides even further benefits over prior systems.

FIG. 23 is a cross section view of a mullion 517 in accordance with the present invention. Mullion 517 is similar to transom 511. Mullion 517 includes structure components 500*a*, 500*b* connected together. A stem 501 extends between panels 50, 50. In a retrofit application, component 502 is bonded to structure 500*a* in the field with an adhesive such as with an adhesive tape and/or with other bonding products or techniques as described herein. Component 503 is bonded in the field to structure 500*b* in similar manner. The remaining aspects of mullion 517 are similar or identical to those of transom 511. A cover plate 518 is connected as desired. The mullion 517 is a vertical oriented structure. The transom 511 in other aspects is positioned adjacent an existing head or an existing sill of a window wall system (with the absence of one of the panels 50 to accommodate positioning adjacent the head or sill, respectively) and placing the frame 500 and a riser (in the case of a sill configuration) with a seal and a primary seal against the sill. In a retrofit application the existing primary seal and interior framing remain while the components 502, 503 and new perimeter spacer (in place of panel), new panel 50, new gasket 516, new gasket spacer 515 and exterior seals are used. Mullion 517 in other aspects is also positioned adjacent a jamb yet with bonded components 502, 503, a new perimeter spacer (in place of the panel) and new glass. The foregoing allows for retrofit of an entire window wall system.

Figure 24:
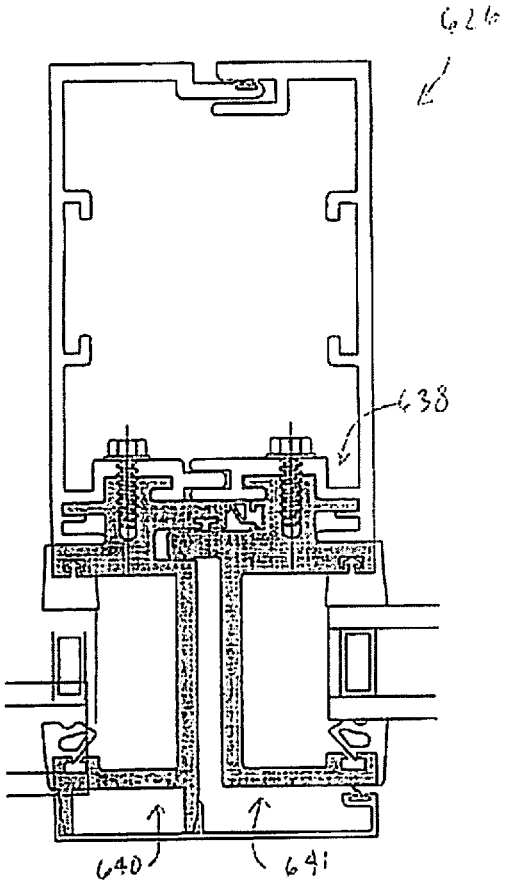
FIG. 24 is a section view of a mullion structure according to a further aspect of the invention.
Figure 25:
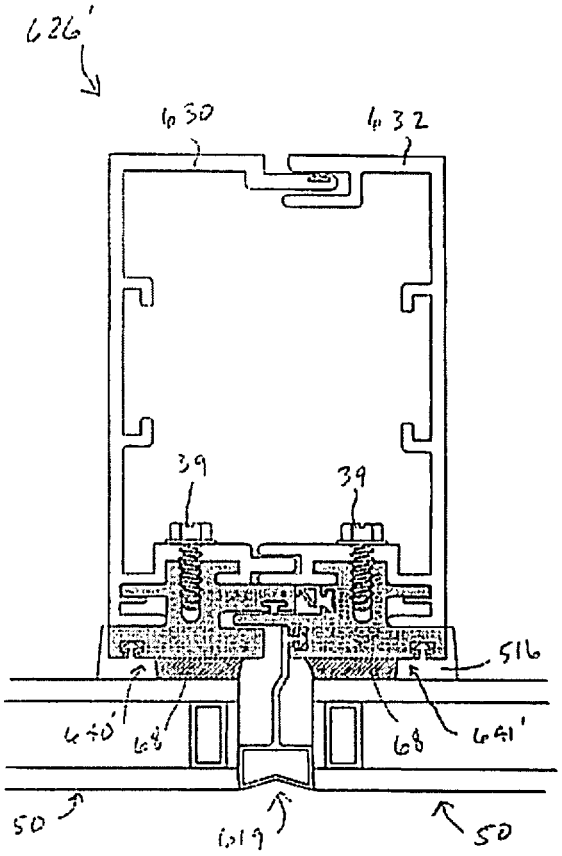
FIG. 25 is a section view of a mullion structure according to a further aspect of the invention.
Figure 26:
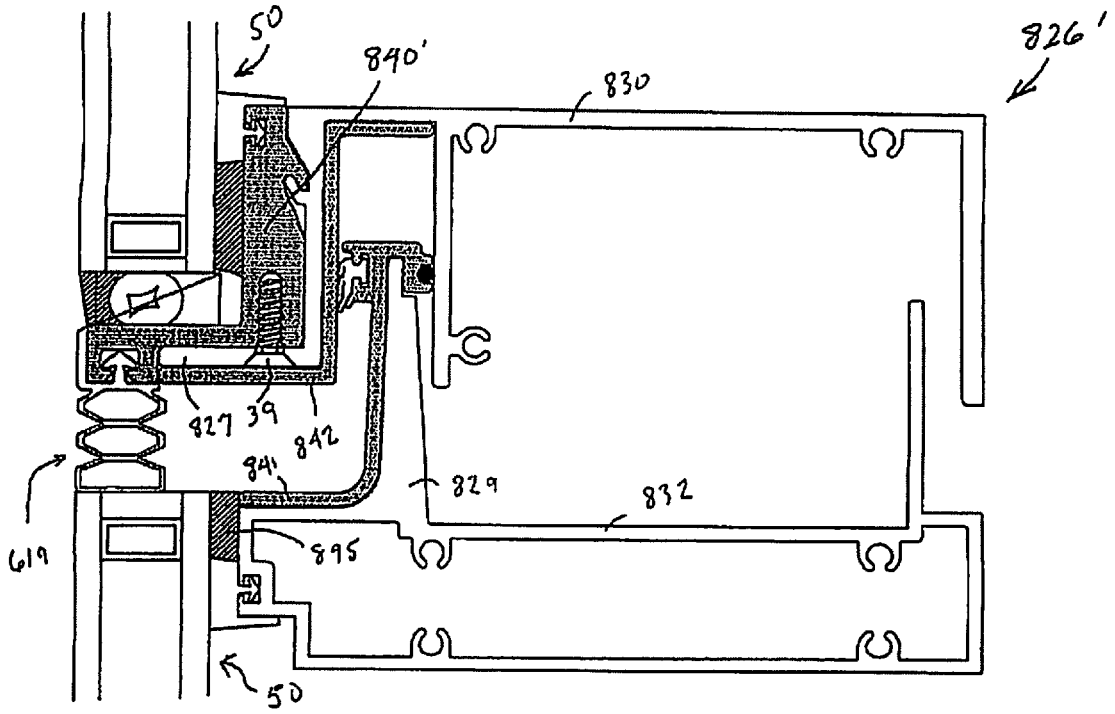
FIG. 26 is a section view of a transom structure according to a further aspect of the invention.

FIGS. 24-26 are section views depicting further aspects of the present invention. FIG. 24 depicts a unitized vertical structure 626 and is identical or nearly identical to the structure 626 shown in FIG. 15. The portions of the components 640, 641 which are positioned in the head portions 638 are slightly different in the mullion of FIG. 24 as compared to the mullion of FIG. 15. FIG. 25 shows mullion 626' which is an alternative aspect of the mullion 626. Mullion 626' is also a unitized vertical structure and does not wrap around the panels as does mullion 626. Mullion 626' includes components 640', 641' covering outward facing surfaces of metal segments 630, 632. Components 640', 641' are made of materials like the other insulating components noted herein. Various seals are positioned within or between components 640', 641' and metal segments 630, 632 and each other. Panels 50, 50 are secured to components 640', 641' with layers of structural silicone 68, for instance. Use of structural silicone 68 and/or glazing tape is sufficient to hold panels 50 without use of fasteners or wrap around structures. Silicone gaskets with molded corners 516 are also used to affix panels 50 to components 640', 641' and to achieve a desired seal. A silicone weather seal gasket 619 is positioned within a gap defined by the panels 50, 50 and secures to one of the components. Gasket 619 in one aspect is installed in the shop. For assembly, one side of the system such as the segment 632 to which is connected the panel 50 and component 641' (component 641' fastened with an inside-out fastener 39), is mated with the other side of the system such as the segment 630 to which is connected the panel 50 and component 640'. In this manner several segments having associated panels may be assembled into position by simple inserting connections. In a further aspect the invention includes a panel 50 connected to a first segment 630 on one side of the panel and to a second segment 632 on an opposite side of the panel. Such panel 50 with connected segments is then connected to an adjacent or adjacent panels 50 of like variety. Successive connecting of such panels allows for efficient assembly of the system.

FIG. 26 is a cross section view of a unitized horizontal transom structure 826'. Transom 826' is similar in configuration with the transom 826 of FIG. 17. Transom 826' however, does not include the wrap around component 840. Transom 826' includes component 840' which is fastened to first metal segment 830 at wing 827. Component 840' covers the outward facing surface of segment 830. A component 842 is bonded (for instance by adhesive or other manner) to wing 827. Component 841 is hooked on and bonded to jaw 829. The outward facing surface of jaw 829 is covered by component 841. A block connector 895 or structural silicon is used to connect panel 50 to segment 832 at an outward facing surface. A continuous silicone weather seal gasket 619 is connected to panel 50 and segment 840'. Structural silicone is also used, in conjunction with a gasket to secure the upper panel 50 to component 840'. A spacer or riser is positioned between component 840' and panel 50, and a silicone weather seal, for instance, is used to seal the space between component 840' and panel 50 at the gap between panels 50, 50. Wing 827 is configured to support the weight of panel 50. In one instance a PVC splice pin is positioned in component 841 and abuts an inner wall portion of segment 830. Use of transom 826' allows for a unitized transom without having to present a wrap-around holding feature upon the panels 50.

Figure 27:
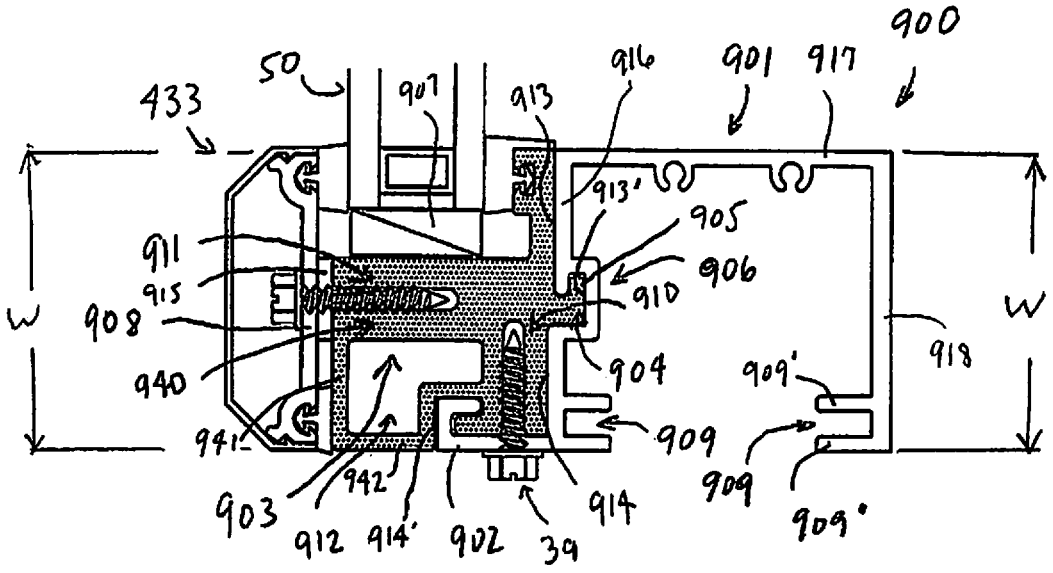
FIG. 27 is a section view of a mullion or transom structure according to a further aspect of the invention.
Figure 31:
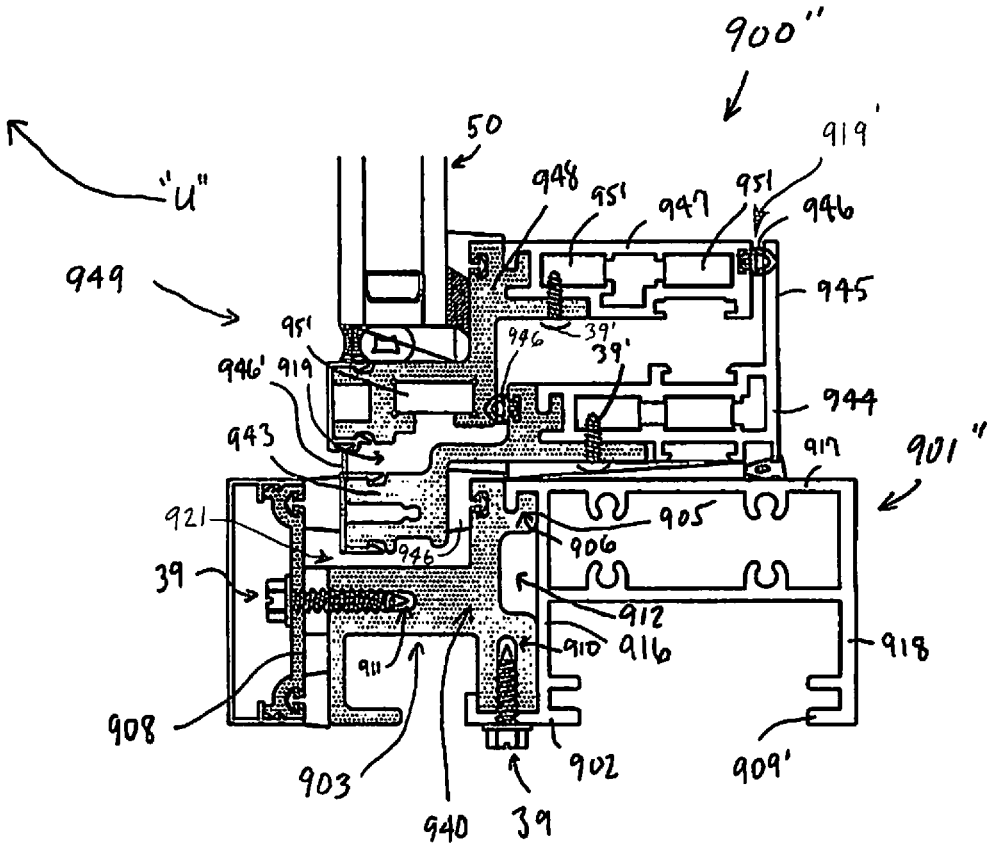
FIG. 31 is a section view of a transom structure according to a further aspect of the invention.

FIG. 27 is a cross section view of a vertical mullion and/or horizontal transom structure for use on a window wall system in accordance with a further aspect of the invention. FIG. 27 shows a structure 900 which is used in conjunction with an anchor affixed to a sill of a window (as in FIG. 29) or, in a flipped orientation, in conjunction with an anchor affixed to a header of a window (as in FIG. 28). A panel 50 spans between the respective header and sill. Mullion or transom structure 900 has a component 940 connected to a frame 901 of structure 900 at an outer side 433 of the structure 900. The metal frame 901 of structure 900 includes an outward extending wall or wing 902 and receives a first fastener 39 passing through the wing 902 and into component 940. Component 940 covers an entirety or substantially an entirety of the outer side 433 of frame 901. Fastener 39 is oriented generally parallel to the outer side of frame 901. In further aspects, fastener 39 has an elongated shank, the shank oriented generally parallel to at least one outward facing surface 913 of the frame 901. Particularly, structure 900 includes a wall 916 as part of frame 901 which frame 901 and wall 916 are situated at an inside area of a building or internal of the panel 50. Wall 916 is an outward facing side wall in that it has an outwardly facing surface 913 facing away from metal structure 901. Wall 916 is oriented vertically, and in one aspect includes segments such that wall 916 extends a total width "W" of structure 900 as shown in FIG. 27. A different version of wall 916 is also shown in FIG. 31 with fewer segments. Side wall 916 connects with a top wall 917 which is oriented generally horizontally and connects with an inside structural wall 918 which is oriented generally vertically. Walls 916, 917 and 918 form a structural member. Additional wall segments may be used in conjunction with walls 916, 917, 918. The outer side 433 of structure 900 spans a total width "W" (see arrow "W", FIG. 27) of the structure. As shown, component 940 covers the entirety or substantially the entirety of the outer side 433. In one aspect component 940 covers all of the outward facing surfaces of frame 901, including outward facing surfaces 914, 914' and 913'. Component 940 is configured to cover all or other outward facing surfaces to provide a desired insulating function. Component 940 comprises material as described of other components herein, and in one aspect includes a thermally insulating fiberglass reinforced polymer. Component 940 in one aspect is a structural support of panel 50 such as in a window wall application. Component 940 includes a stem 903 which projects outward from the outer side of frame 901 to a position to support panel 50. In other applications, such as with use in conjunction with an operable window application (FIG. 31), stem 903 is not relied upon as a support structure to directly support panel 50 when used in an operable application described further below.

In one aspect component 940 defines a first slot 910 which receives the fastener 39. Slot 910 extends the length or nearly an entirety of the length of component 940 (i.e., slot 910 runs longitudinally along or through component 940 (the slot 910 may also be staggered or run intermittently along or through component 940). Slot 910 has parallel walls to securely receive fastener 39. Component 940 includes a second slot 911, similar to first slot 910, configured to receive a second fastener 39. The second slot 911 is oriented perpendicular or generally perpendicular to first slot 910. Fastener 39 passes through a pressure plate 908 and into slot 911. Pressure plate 908 is configured to secure a panel 50 to structure 900 and the system. Stem 903 of component 940 is configured to hold a riser 907 which in turn receives and supports panel 50.

In one aspect component 940 includes a finger 904 positioned in a locking portion 905 of a pocket 906 defined in the frame 901. Component 940 is slid into position by allowing finger 904 to enter pocket 906 and sliding component 940 along the length of frame 901. A further finger 904 and pocket 906 and locking portion 905 is configured adjacent wing 902. Fastener 39 which is positioned through metal wall or wing 902 is oriented in a spaced relationship from the outwardly facing surface 914 (and 914'), for instance. In one aspect frame 901 includes a pair of opposed hands 909, 909 defining a channel configured to receive an anchor connected to a wall to which the system may be connected (See FIG. 29, 28). Each of hands 909, 909 include a pair of fingers 909' defining the hand 909. In one aspect the fingers 909' extend toward opposite fingers of the opposite hand 909. An anchor slides between the fingers 909' of hands 909, 909. In one aspect slots 910 and 911 are pre-set slots so as to minimize or avoid cracking or splitting of component 940 when a fastener 39 is inserted into the slot. A spacer gasket 915 is positioned between pressure plate 908 and stem 903. Component 940 in one aspect defines a void 912 which is in part defined by component wall 941, 942, Component wall 942 provides further structure and together with wall 941 cover outward facing surface 914'. Component 940 is devoid of penetrations passing through component 940 to frame 901, and effectively insulates frame 901 from the exterior environment.

Figure 28:
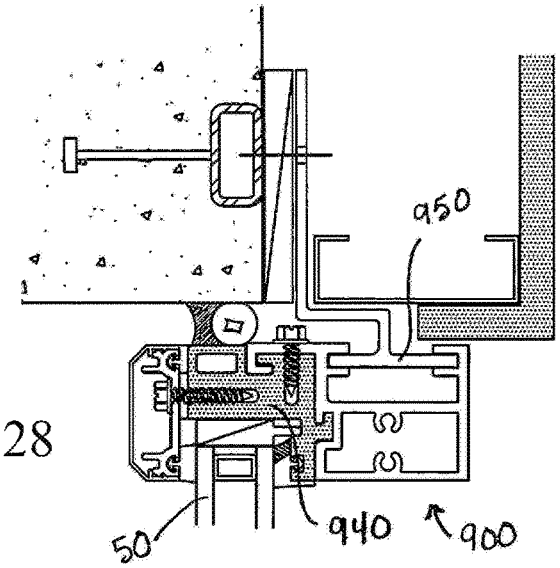
FIG. 28 is a section view of a transom structure according to a further aspect of the invention.
Figure 29:
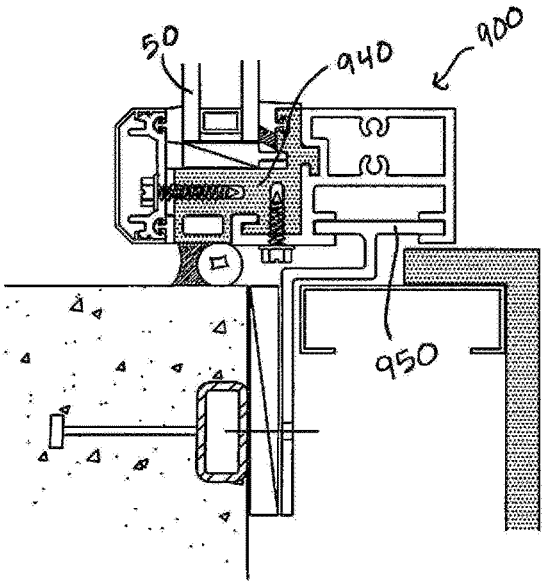
FIG. 29 is a section view of a transom structure according to a further aspect of the invention

FIG. 29 shows use of structure 900 in a window wall application where structure 900 is oriented adjacent a sill. An anchor 950 is fastened to the sill or concrete wall via a bolt or other fastener embedded into the concrete. Anchor 950 may also be affixed to a metal wall or sill or to a wall or sill made of different material. Anchor 950 inserts into the channel formed by opposing hands 909. A seal or seals are positioned between component 940 and the concrete sill and together with component 940 effectively insulates frame 901 from the external environment. FIG. 28 shows a cross section of a companion to the sill of FIG. 29 and depicts a variation of structure 900 used in a header position (or the structure of the sill position is flipped to the header position). A component 940 having identical structure to the component 940 of FIG. 29 is used. A panel 50 may span between the header of FIG. 28 and the sill of FIG. 29. In one aspect, a horizontal structure, such as that shown in FIG. 11, is used in conjunction with the header and sill structures (i.e. as a horizontal in a non-sill or non-header position), especially in a situation of a fixed punched window configuration.

Figure 30:
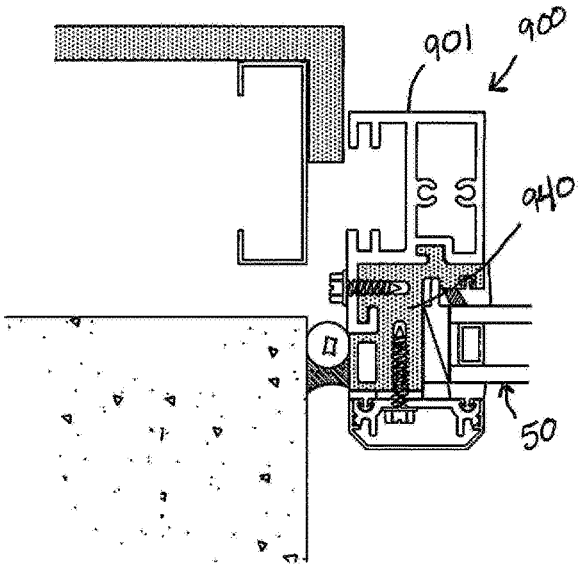
FIG. 30 is a section view of a mullion structure according to a further aspect of the invention.

FIG. 30 is a cross section view showing a variation of structure 900 used in a vertical orientation. The structure 900 of FIG. 30 is used in conjunction with the horizontal structures of FIGS. 28, 29. Component 940 and seals positioned adjacent the concrete wall, together with panel 50, effectively isolate frame 901 from the external environment. The height and thicknesses of structure 900 may be varied as desired to accommodate different window sizes and structural requirement.

FIG. 31 is a cross section view showing a further aspect of a mullion or transom of the invention as used in an operable window application. Mullion or transom 900" is a variation of structure 900 of FIG. 27. Structure 900" includes frame 901' which is a variation of frame 901 of FIG. 27. Frame 901' includes wall 916 which receives component 940 at outer side 433. In this particular aspect side wall 916 spans the entire total width of frame 901. Component 940 includes an interlock created by a locking portion 905 positioned within pocket 906. A void 912 is defined by component 940 and wall 916. Void 912 which acts as a partial thermal break provides an improved insulating or "R" value for structure 900". The foregoing interlock with locking portion 905 and pocket 906 positioned at an upward portion of wall 914 may also be utilized with the structure 900 shown in FIG. 27. A fastener 39 is positioned within slot 910 to secure component 940 and in one aspect is oriented parallel to or generally parallel with wall 916. A further or second fastener 39 is oriented perpendicularly to or generally perpendicularly with first fastener 39. It may be appreciated that multiple fasteners 39 are inserted along the length of component 940 to secure the component along a length of structure 900". Second fastener 39 is secured through a pressure plate 908. In one instance, this pressure plate 908 is made of the same or similar material as component 940, such as a fiberglass reinforced polymer as referenced throughout this description. The pressure plate 908 as shown in FIG. 31 may also be used as pressure plate 908 in FIG. 27.

Pressure plate 908 when secured with second fastener 39 exerts a pressure force against seals which in turn force against component 940 and a further component 943. Component 943 is made of the same materials as component 940 described herein. Component 943 extends to a position on top of structure or frame 901. Component 943 is fastened to a metal frame structure 944 by use of a fastener 39'. Frame structure 944 is part of a frame assembly for use as an operable window as described further herein. In one aspect component 943 rests upon a spacer or shim as needed, and a continuous wedge or joint filler (made of EDPM material, for instance) is used between component 943 and frame 901. Frame structure 944 has an upward extending frame wall 945 against which is positioned a seal or weather gasket 946 associated with a sash assembly 947 of the operable window having panel 50. Component 943 is connected to and covers a side of the frame structure 944 at a side wall and spans a total width of the side wall (See FIG. 31 and FIG. 32). The side wall or side wall portions of frame structure 944 are completely isolated from exposure to the exterior.

Component 948 is connected to sash assembly 947. Sash assembly 947 is a structural member of operable window 949. Component 948 is made of material such as the fiberglass thermal barrier material describe herein regarding the other components. Panel 50 is secured to component 948, for instance by use of an adhesive, and a shim or spacer between panel 50 and component 948 is used as needed. In one aspect component 948 is connected to assembly 947 with a fastener 39'. Component 948 is configured and positioned such that a gap 919 exists between component 948 and component 943. In aspects, the gap 919 also extends between component 948 and frame structure 944, and sash assembly 947 and frame structure 944, represented in part as gap 919' as shown in FIG. 31. A seal or gasket 946 is also positioned within the gap 919 formed between component 948 and component 943. Additional seal or gasket 946 may also be included within the gap 919, 919'. While the seal or gasket 946 is shown to be connected to second component 943 and configured to abut component 948, the seal or gaskets may be alternatively connected to the component 948 and configured to abut component 943. An outward sweep gasket 946' is utilized between component 948 and component 943 to provide sealing and accommodates sealing as operable window 949 sweeps outward or inward along the top portion of frame 901, 944. For instance, in one aspect operable window 949 is supported and hinged at a top portion and sweeps outward and upward as shown with reference to direction arrow "U" in FIG. 31. As window 949 closes in the direction opposite arrow "U", sash assembly 947 resets into position as shown in FIG. 31 with gaskets 946 providing further sealing action. Window 949 seats upon or against fixed window assembly structure 901". In one aspect sash assembly 947 is an aluminum extruded structure. An assembly corner key 951 or corner keys 951 represent the use of a corner key structure for illustration purposes. Aluminum covers are applied to outer face of components 943, 948, 908 as desired. In one aspect, component 940 and component 943 define a gap 921. A seal or gasket 946 is positioned in the gap and abuts both component 940 and component 943. In a further aspect component 940 and component 943 are combined into a single element that is configured to secure to outer side of frame 901" while also extending over top wall 917. The combined element is slid longitudinally upon frame 901".

Figure 32:
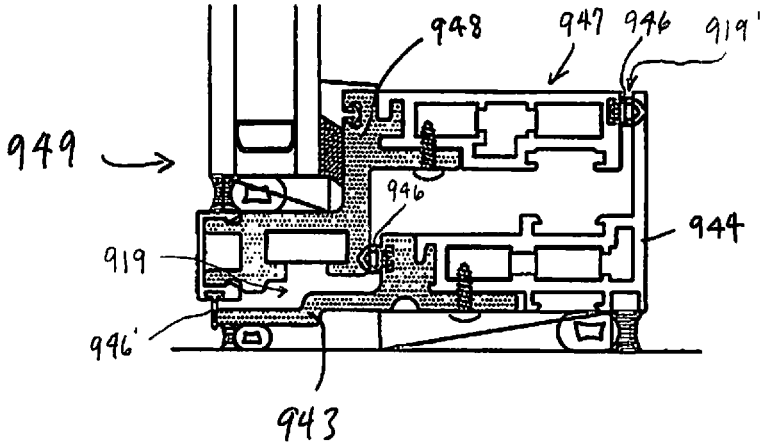
FIG. 32 is a section view of a transom structure according to a further aspect of the invention.

FIG. 32 is a cross section view of a further aspect of a fixed window assembly structure or frame structure 944, which receives operable window 949. In this aspect frame structure 944 is placed on a sill or other structure of a building, such as a 2×4 or 2×6 wooden frame structure or other supporting structure. In this aspect the component 943 is a modification of component 943 shown in FIG. 31 to accommodate placement on the sill or building line. The same frame structure 944 may be used as was used in FIG. 31 and modified component 943 fastened to structure 944. Component 943 has a lower profile to accommodate use in conjunction with various building conditions or structures. Perimeter caulking and shims or spacers are positioned between the building line and component 943. The components 943, 948 are connected to the metal structures and provide a thermal barrier for improved efficiency even in an operable window application. In one aspect, components 943, 948 define a gap 919. A gasket 946 is provided in the gap 919 and abuts both components 943, 948. In aspects, the gap 919 also extends between component 948 and frame structure 944, and sash assembly 947 and frame structure 944, represented in part as gap 919' as shown in FIG. 32. Additional seal or gasket 946 may also be included within the gap 919, 919'. Operable window 949 is supported and hinged at a top portion and sweeps outward and upward similar to the upward and outward swing of window 949 in FIG. 31. An outward sweep gasket 946' is utilized between component 948 and component 943 to provide sealing and accommodates sealing as operable window 949 sweeps outward or inward along the top portion of structure 944.

Further aspects of the invention include a method of installing the systems as presented herein which include the step of preparing the frames with the components and panels as presented and then having the panels received at a job location for installation with a step including securing the panels to a window or curtain wall system. A further method aspect includes retrofitting a prior system with the systems described herein.

Figure 33:
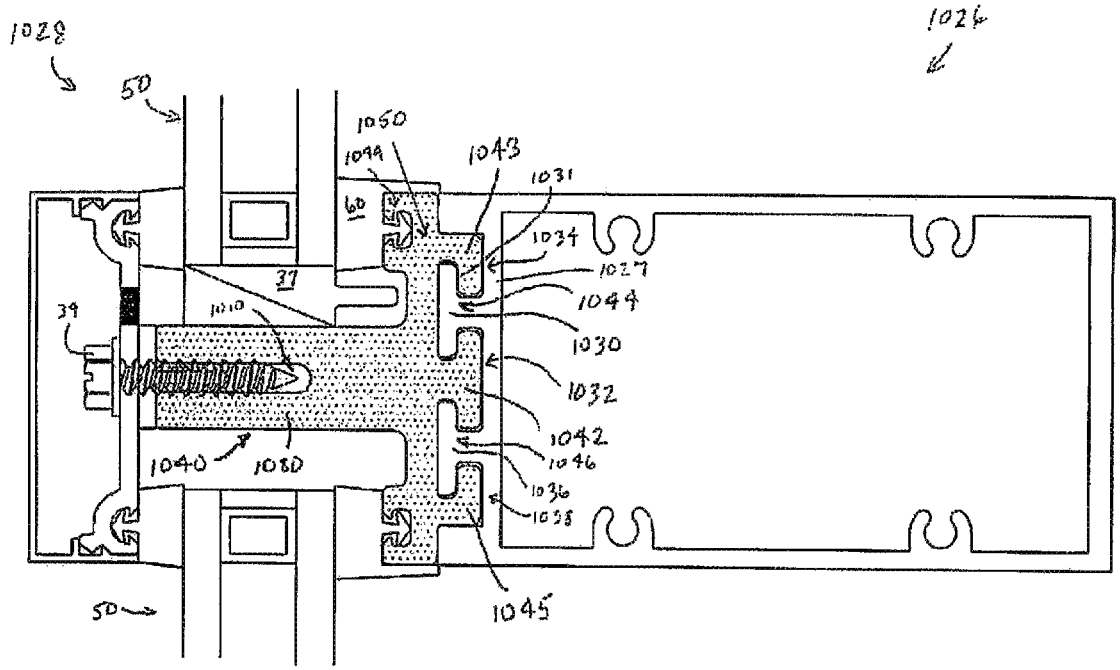
FIG. 33 is a section view of a transom structure according to a further aspect of the invention.

FIG. 33 is a section view of a transom structure according to a further aspect of the invention. Transom 1026 is made of metal, including made of aluminum, and includes an outer side 1028 to which is connected a component 1040 made of fiberglass reinforced polymer. Component 1040 is connected to the metal structure 1027 at the outer side 1028 by interlocking connection 1050 between the component 1040 and the metal structure 1027. The interlocking connection is a fastener-less connection in that it is devoid of a faster. For instance, no faster is required to pass through metal structure 1027 and into component 1040. Such fastener-less connection allows for a solid connection without impacting the structural integrity of the structure 1027 or exposing the structure 1027 and/or the areas within structure 1027 to unwanted thermal contact or communication with the outside environment. In one instance, interlocking connection 1050 is the sole connection between component 1040 and metal structure 1027. In some aspects interlocking connection 1050 may utilize several interlocking elements as shown and as may be appreciated. In other instances an adhesive may also be used in conjunction with the interlocking connection 1050 or at least with some of the interlocking elements. As referenced further herein, a press-fit step or configuration is used to establish the interlocking connection 1050. In further aspects component 1040 may include a void, such as the void 912 used in FIG. 31, to provide an air or thermal barrier between component 1040 and metal structure 1027.

Component 1040 is configured to support a first panel 50. In one aspect outer side 1028 includes a structural head 1030 which projects from a transom wall 1027 of transom 1026. In one aspect a second structural head 1036 extends from transom wall 1027. Structural head 1030 in part defines a structural channel 1032 which is configured to receive a component head 1042 as described below. In one aspect second structural head 1036 in part defines structural channel 1032. In one aspect structural head 1030 has a T-shaped transverse cross section which extends lengthwise along metal structure 1026. Structural head 1030 is configured to engage with a reciprocal T-shaped channel 1044 defined by component 1040. T-shaped channel 1044 in one aspect extends lengthwise along component 1040. In one aspect third structural channel 1038 is defined by outer side 1028 of transom 1026. Third structural channel 1038 is configured to receive third component head 1045 of component 1040. The structural heads and component channels form interlocks for secure interlocking of the parts.

Component 1040 is connected to transom 1026 by an interlocking connection 1050 between component 1040 and the metal structure so as to cover an entirety or substantially an entirety of the outer side 1028 of transom 1026 (i.e., the entirety of a width of transom 1026). In one aspect interlocking connection 1050 is formed by longitudinal insertion of component 1040 within structural channel 1032 (and/or within second structural channel 1034 and/or third structural channel 1038). Component 1040 is connected by press-fitting component head 1042 longitudinally into the channel 1032 and sliding component 1040 along a length of transom 1026. Component 1040 includes an integrally connected stem 1080 projecting into a space between a first panel 50 and a second panel 50 of the curtain wall or window wall system. In one aspect a spacer 37 rests upon stem 1080 to support panel 50. Component 1040 includes seal receivers 1049 to receive a seal 60 which abuts at an inside of panel 50. At an outside end of component 1040 is defined a preset slot 1010 which is configured to receive a fastener 39 having threads which screws into the slot 1010 to provide pressure against a pressure plate 1008. Pressure plate 1008 applies pressure against seals which in turn press against panels 50 to securely hold the panels 50 into position. A gap between pressure plate and a terminal end of component 1040 allows fastener 39 to induce a pressure against the plate 1008 when fastener is tightened. A downward force caused by the weight of panel 50 in turn imparts an outward pulling force upon component 1040, which is resisted by interlock 1050 or a series of similar interlocks. Structural head 1030 friction fits within component channel 1044. In addition, the outward pulling force causes second component head 1043, for instance, to press against or more firmly press against an outermost inward facing surface 1031 of structural head 1030. It may be appreciated that structural head 1030 has a similar inward facing surface 1031 at the other side of the "T-shaped" configuration against which component head 1042 abuts or more firmly presses. Such arrangement provides a secure interlock 1050 of component 1040 to transom wall 1027 without having any metal parts contact wall 1027 and while simultaneously completely covering the outer side 1028 with a thermally insulating component 1040. The interlock 1050 is created when the component heads 1042, 1043, 1045 of component 1040 are slid longitudinally into structural channels 1032, 1034 and 1038 (and/or when the simultaneous sliding of structural heads 1030, 1036 into component channels 1044, 1046). The component 1040 is connected to the metal structure at the outer side 1028 solely by the interlocking connections. Such exclusively interlocked connection provides an effective thermal barrier and insulation of the outer surface of the transom or mullion structure. There are no fasteners or connectors or metal screws which penetrate into or through component 1040 into or through outer side 1028. The absence of such fasteners or connectors isolates the surface and structure so that the cold or warm or wet or dry outside environment does not contact the surfaces. This barrier leads to new and unexpected efficiencies in terms of insulation and "R" value effectiveness. Connection solely by an interlocking connection between the component and the metal structure, as shown, with the covering of an entirety of the outer side, provides an effective and efficient barrier for improved thermal isolation. In one aspect the interlock or interlocks are formed upon longitudinally sliding a structural head of the metal structure within a component channel of the component. In one aspect the structural head has a T-shaped transverse cross section that extends lengthwise along the meal structure and within the component channel, the component channel having a corresponding T-shaped cross section to receive the head.

In one instance as shown in FIG. 33, the interlocks 1050 include four separate inward facing surfaces 1031 against which an outward-pulling component 1040 is locked. More-over, given the snug fit of the T-shaped structural heads 1030, 1036 within the corresponding T-shaped component channels 1044, 1046, and the snug fit of the component head 1042, second component head 1043 and third component head 1045 against respective channel structures, rotation or detachment of component 1040 from wall 1027 is prevented. The fiber-reinforced polymer component 1040, including the component head 1042 and component channel 1044 structures, for instance, has a strength sufficient to provide structural support of panel 50, including the support necessary to accommodate for environmental forces or loads due to high winds or other environmental factors. Component 1040 is devoid of penetrations from an outside to an inside of the component. Slot 1010 extends only partially inward (and not entirely through component 1040) to assure a sufficient isolation of metal fastener 39 from metal wall structure 1034. Slot 1010 is preset to accommodate insertion of fastener 39 without cracking or undue damage to component 1040 and to provide centering alignment during installation. In one aspect, slot 1010 extends longitudinally the length of component 1040. In one aspect component 1040 is sized lengthwise to match the length of metal structure of transom 1026, and in some instances transom 26 spans several feet, such as 4 to 8 to 25 feet or greater. The interlocks 1050 span the length of transom to provide a solid connection along the entire length of the structure. Transom 1026 is configured for use on a curtain wall or window wall system.

Figure 34:
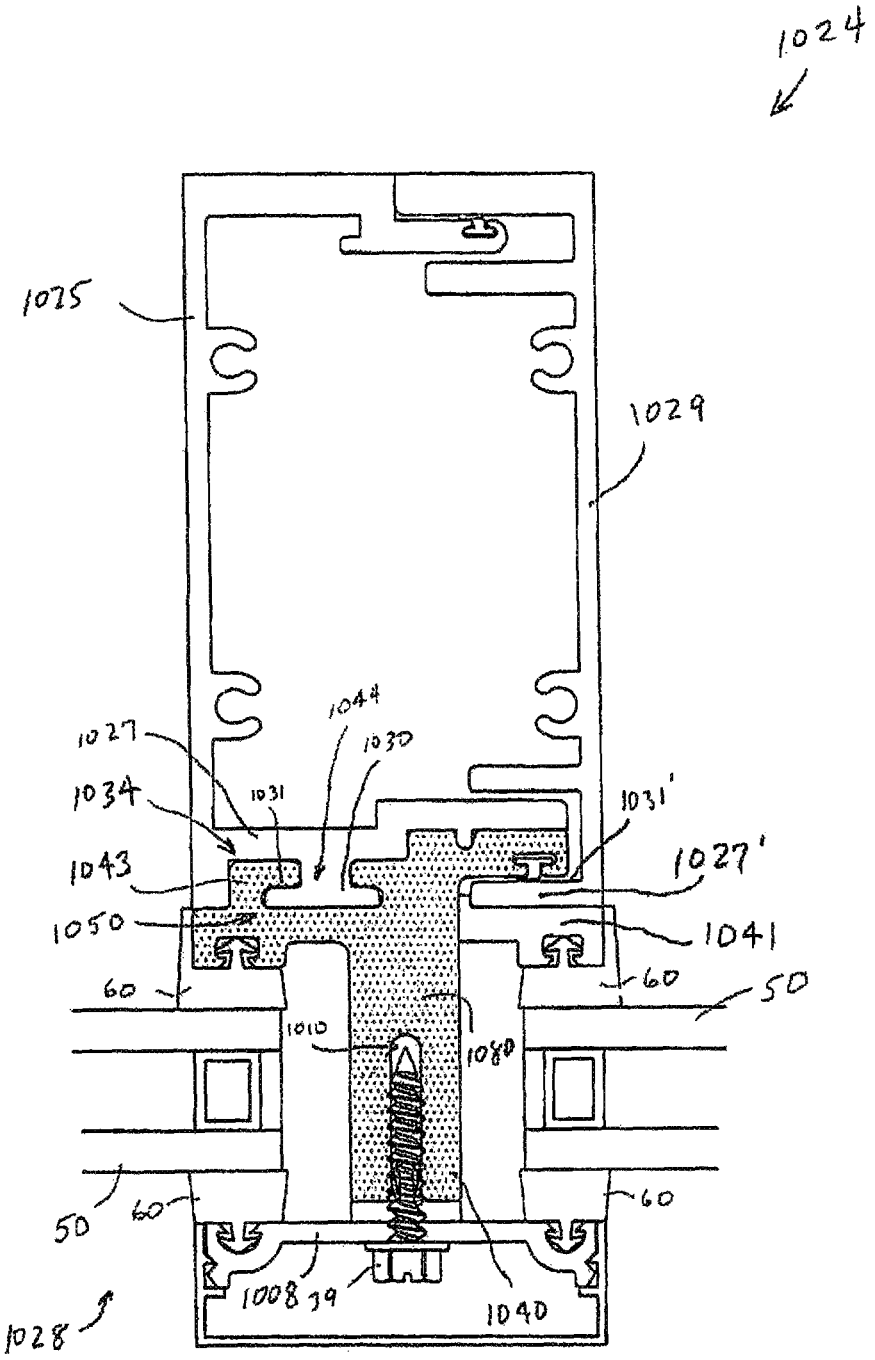
FIG. 34 is a section view of a mullion structure according to a further aspect of the invention.

FIG. 34 is a section view of a mullion structure according to a further aspect of the invention. Mullion 1024 includes a first mullion segment 1025 connected to a second mullion segment 1029. Segments 1025, 1029 are made of metal and fit together lengthwise to form a solid structural mullion support. An interlock 1050 is formed between segment 1025 and first fiberglass reinforced polymer component 1040. Interlock 1050 at mullion 1024 is the same, similar or substantially the same as interlock 1050 at transom 1026. In one aspect a structural head 1030 projects from wall 1027 and into a component channel 1044. In one aspect structural head 1030 has a T-shaped transverse cross section that extends lengthwise along the first component 1040, and mates with a reciprocal T-shaped component channel 1044 formed within or defined by first component 1040. Component 1040 includes stem 1080 which extends between opposed panels 50 and includes a preset slot 1010 to receive fastener 39. Fastener 39 inserts through pressure plate 1008 and into slot 1010 to apply pressure against seals 60 which in turn apply pressure against panels 50 for secure positioning. Component 1040 is configured to cover an entirety or substantially an entirety of an outer side 1028 of segment 1025. In one aspect component 1040 is configured to structurally support a panel 50 of a curtain wall or window wall system. A spacer may be inserted between panel 50 and stem 1080. In other aspects component 1040 when connected to mullion 1024 is configured to accommodate pressure fitting of panel 50 against mullion 1024 while providing an efficient thermal break. In one aspect component 1040 is connected to wall 1027 solely via interlocking connection 1050. No fasteners are needed. In a further aspect mullion segment 1029 includes an outer wall 1027' at an outer side 1028 of mullion 1024. A second component 1041 is connected to outer wall 1027'. Component 1041 in one aspect is connected to wall 1027' via adhesive, including by an adhesive bond. A double-sided adhesive strip in one instance is used to bond component 1041 to wall 1027'. Component 1041 covers an entirety of wall 1027'. In one aspect component 1041 abuts component 1040. In one aspect component 1041 is a fiberglass reinforced polymer. Component 1040 and 1041 together operate to completely cover, or at least substantially cover, the outer side 1028 of mullion 1024. A seal in one aspect is provided between component 1040 and an inward facing surface 1031'. In one aspect a portion of second component 1041 is positioned between first component 1040 and a terminal edge of outer wall 1027'.

In assembly, component 1040 is connected to segment 1025. Seals are then added. Component 1041 is connected to wall 1027', and then segment 1029 is connected to segment 1025 lengthwise along their lengths. Such lengthwise connection creates a solid structural member for use in a curtain wall or window wall system. Component 1040 and segment 1025 are connected by longitudinally sliding them together, with structural head 1030 sliding within component channel 1044 to form an interlocking connection 1050. Such interlocking connection 1050, or multiple such interlocking connections 1050, is the sole connection necessary to connect the component to the metal structure. Once components 1040, 1041 are connected to segments 1025, 1029, and the respective segments 1025, 1029 are connected, seals are positioned within seal receivers of components 1040, 1041 which abut against inside surfaces of respective panels 50, 50. The longitudinal sliding connection of component 1040 and segment 1025 creates a friction fit among the surfaces of the T-shaped elements. Because the components 1040 and segments 1025 are or can be very long, a significant amount of pressure in some instances is required to longitudinally press-fit the parts together. The tolerances between surfaces of the respective T-shaped elements can be varied to adjust the relative force (and resulting tension of friction fit) needed or used to longitudinally slide the parts together.

Further aspects of the invention include a method of manufacturing a vertical mullion or horizontal transom structure for use on a curtain wall or window wall system including the step of longitudinally sliding together a component made of fiberglass reinforced polymer with a metal structure having an outer side, where the outer side and polymer component connect via an interlocking connection, the component covering the entirety or substantially the entirety of the outer side of the structure, the component having a stem configured to extend between a gap created by opposed panels of the system in which the mullion or transom is used, the component configured to structurally support a panel of the system.

It should be understood, of course, that the foregoing relates to exemplary embodiments of the invention and that modifications may be made without departing from the spirit and scope of the invention as set forth in the following claims. The scope of this invention also includes embodiments having different combinations of features and embodiments that do not include all of the above described features.

What is claimed is:

1. A structure for use with an operable window, the structure comprising:

a metal mullion or transom first structure having a side wall and a top wall;

a first thermally insulated polymer component connected at a side of the first structure at the side wall and spanning substantially a total width of the first structure; and a second thermally insulated polymer component positioned at the top wall and connected to a second metal structure, the second thermally insulated polymer component extends to the side of the first structure and is configured to receive at least a portion of an operable window where at least a portion of the second component extends from atop the top wall downward to the side of the first structure.

2. The structure of claim 1 where the first component and the second component each comprise a fiberglass reinforced polymer.

3. The structure of claim 1 where the first structure includes a side wall which spans a total width of the first structure, the first component abuts against the side wall and is connected to the first structure with a fastener aligned parallel to the side wall.

4. The structure of claim 1 further including an operable window having a third component connected to a sash assembly structure, the third component positionable adjacent the second component, the sash assembly structure positionable adjacent the second metal structure.

5. The structure of claim 4 where the third component comprises a fiberglass reinforced polymer fastened to the sash with a fastener.

6. The structure of claim 4 where at least two seals are positioned within a gap between the third component and the second component.

7. An operable window system comprising:

a metal mullion or transom first structure configured to receive an operable window, the first structure comprising:

a first thermally insulated polymer component connected to a side of the first structure at a side wall and spanning substantially a total width of the first structure; and a second thermally insulated polymer component positioned at a top wall of the first structure and connected to a second metal structure, the first thermally insulated polymer component and the second thermally insulated polymer component defining a first gap therebetween and having at least a first seal positioned therein; and an operable window configured to close to a position defining a second gap between the window and the second thermally insulated polymer component, at least a second seal positioned in the second gap and abutting both the operable window and the second thermally insulated polymer component.

8. The window system of claim 7 where the window also closes to a position defining a gap between the window and the second metal structure, at least one seal positioned in the gap between the window and the second metal structure and abutting both the window and the second metal structure.

9. The window system of claim 7 where the first component is integrally connected to the second component.

10. The window system of claim 7 where the first thermally insulated polymer component comprises a fiberglass reinforced polymer.

11. The window system of claim 7 where the operable window includes a third thermally insulated polymer component, the gap defined by the third component and the second thermally insulated polymer component.

12. The window system of claim 11 where the third component is connected to a metal sash assembly, the sash assembly and the second metal structure defining a second gap, a seal positioned within the second gap and contacting the sash assembly and the second metal structure when the window is in a closed position.

13. The window system of claim 7 where the window pivots outwardly away from the second component.

14. The window system of claim 7 where the second thermally insulated polymer component is connected to the top wall by adhesive.

15. The window system of claim 7 where the first thermally insulated polymer component is connected to the first metal structure via an interlock, the first component and the first metal structure defining a void.

16. The window system of claim 7 where the side wall is generally planar, the first component connected to the first metal structure with a fastener oriented generally parallel the side wall.

17. An operable window system comprising:

a metal frame structure configured to receive an operable window, the frame structure comprising:

a first thermally insulated polymer component connected to a side of the frame structure at a side wall and spanning a total width of the side wall; and an operable window having a second thermally insulated polymer component connected to a sash assembly, the window configured to close to a position defining a first gap between the second thermally insulated polymer component and the first thermally insulated polymer component and a second gap between the sash assembly and the frame structure, at least one seal positioned in the first gap and abutting both the second component and the first component and at least one seal positioned in the second gap and abutting both the sash assembly and the frame structure.

18. The system of claim 17 where the first component is connected to the side of the frame structure via an interlock and a fastener and the second component is connected to the sash assembly via an interlock and a fastener.

19. The system of claim 17 where the frame structure is positioned upon a metal mullion or transom structure, the metal mullion or transom structure including a polymer component connected to an outer side of the mullion or transom structure.

20. A structure for use with an operable window, the structure comprising:

a metal mullion or transom first structure having a side wall and a top wall;

a first thermally insulated polymer component connected at a side of the first structure at the side wall and spanning substantially a total width of the first structure; and a second thermally insulated polymer component positioned at the top wall and connected to a second metal structure, the second thermally insulated polymer component extends to the side of the first structure and is configured to receive at least a portion of an operable window where the first thermally insulated polymer component and the second thermally insulated polymer component have opposing surfaces defining a gap therebetween and having a seal positioned therein.

* * * * *